US005882829A

United States Patent [19]

Hsieh et al.

[11] Patent Number: 5,882,829

[45] Date of Patent: Mar. 16, 1999

[54] PHOTORECEPTOR CONTAINING IMPROVED CHARGE TRANSPORTING SMALL MOLECULE

[75] Inventors: Bing R. Hsieh; Satchidanand Mishra, both of Webster; Donald C. VonHoene, Fairport; Anthony M. Horgan, Pittsford; Robert C.U. Yu, Webster; Richard L. Post, Penfield; Edward F. Grabowski, Webster, all of N.Y.

[73] Assignee: Xerox Corporation, Stamford, Conn.

[21] Appl. No.: 961,301

[22] Filed: Oct. 30, 1997

Related U.S. Application Data

[63] Continuation-in-part of Ser. No. 886,101, Jun. 30, 1997.

[51] Int. Cl.[6] ..... G03G 5/047

[52] U.S. Cl. ..... 430/59; 430/126

[58] Field of Search ..... 430/59, 73, 79, 430/126

[56] References Cited

U.S. PATENT DOCUMENTS

| | | | |
|---|---|---|---|
| 4,265,990 | 5/1981 | Stolka et al. | 430/59 |
| 4,582,772 | 4/1986 | Teuscher et al. | 430/58 |
| 4,788,336 | 11/1988 | Rule | 564/315 |
| 4,801,517 | 1/1989 | Frechet et al. | 430/59 |
| 4,806,443 | 2/1989 | Yanus et al. | 430/56 |
| 4,806,444 | 2/1989 | Yanus et al | 430/56 |
| 4,818,650 | 4/1989 | Limburg et al. | 430/56 |
| 4,871,634 | 10/1989 | Limburg et al. | 430/54 |
| 4,935,487 | 6/1990 | Yanus et al. | 528/202 |
| 4,956,440 | 9/1990 | Limburg et al. | 528/99 |
| 5,093,698 | 3/1992 | Egusa et al. | 357/17 |
| 5,294,810 | 3/1994 | Egusa et al. | 257/40 |
| 5,554,450 | 9/1996 | Shi et al. | 428/690 |
| 5,747,205 | 5/1998 | Hu et al. | 430/59 |

*Primary Examiner*—John Goodrow

[57] ABSTRACT

An electrophotographic imaging member including a supporting substrate and at least one photoconductive layer, the photoconductive layer comprising a charge transporting material selected from the group consisting of six categories of organic aromatic polyarylamine materials. These six categories of polyarylamine materials are described in detail. The at least one photoconductive layer may be a single photoconductive layer or comprise a combination of layers such as a charge generating layer and a charge transport layer. This imaging member may be utilized in an electrophotographic imaging process.

20 Claims, No Drawings

PHOTORECEPTOR CONTAINING IMPROVED CHARGE TRANSPORTING SMALL MOLECULE

This application is a continuation-in-part of copending application Ser. No. 08/886,101, filed on Jun. 30, 1997.

BACKGROUND OF THE INVENTION

This invention relates in general to electrophotographic imaging members and more specifically, to imaging members having an improved charge transport layer and process for using the imaging members.

In the art of electrophotography an electrophotographic plate comprising a photoconductive insulating layer on a conductive layer is imaged by first uniformly electrostatically charging the imaging surface of the photoconductive insulating layer. The plate or photoreceptor is then exposed to a pattern of activating electromagnetic radiation such as light, which selectively dissipates the charge in the illuminated areas of the photoconductive insulating layer while leaving behind an electrostatic latent image in the non-illuminated area. This electrostatic latent image may then be developed to form a visible image by depositing finely divided toner particles on the surface of the photoconductive insulating layer. The resulting visible toner image can be transferred to a suitable receiving member such as paper. This imaging process may be repeated many times with reusable photoconductive insulating layers.

The photoreceptor may comprise a conductive layer and a single electrically active layer. This single electrically active material comprises both charge generating material and charge transporting material.

One especially common type of photoreceptor is a multilayered device that comprises a conductive layer, a charge generating layer, and a charge transport layer. Either the charge generating layer or the charge transport layer may be located adjacent the conductive layer. The charge transport layer can contain an active aromatic diamine small molecule charge transport compound dissolved or molecularly dispersed in a film forming binder. This type of charge transport layer is described, for example in U.S. Pat. No. 4,265,990. Although excellent toner images may be obtained with such multilayered photoreceptors, it has been found that when high concentrations of active aromatic diamine small molecule charge transport compound are dissolved or molecularly dispersed in a film forming binder the small molecules tend to crystallize with time under conditions such as higher machine operating temperatures, mechanical stress or exposure to chemical vapors. Such crystallization can cause undesirable changes in the electro-optical properties, such as residual potential build-up which can cause cycle-up. Moreover, the range of binders and binder solvent types available for use during coating operations is limited when high concentrations of the small molecules are sought for the charge transport layer. For example, active aromatic diamine small molecules do not disperse in polyurethane binders. Limited selection of binders and binder solvents can affect the life and stability of a photoreceptor under extended cycling conditions. Moreover, such limited selection also affects the choice of binders and solvents used in subsequently applied layers. For example, the solvents employed for subsequently applied layers should not adversely affect any of the underlying layers. This solvent attack problem is particularly acute in dip coating processes. Further, some of the solvents that are commonly utilized, such as methylene chloride, are marginal solvents from the point of view of environmental toxicity.

Another type of charge transport layer has been developed which utilizes a charge transporting polymer. This type of charge transport polymer includes materials such as poly N-vinyl carbazole, polysilylenes, and others including those described in U.S. Pat. No. 4,806,443, U.S. Pat. No. 4,806,444, U.S. Pat. No. 4,818,650, U.S. Pat. No. 4,935,487, and U.S. Pat. No. 4,956,440. Some polymeric charge transporting materials have relatively low charge carrier mobilities. Moreover, the cost of charge transporting polymers having high concentrations of charge transporting moieties in the polymer chain can be very costly. Further, the mechanical properties of charge transporting polymers such as wearability, hardness and craze resistance are reduced when the relative concentration of charge transporting moieties in the chain is increased.

Thus, in imaging systems utilizing multilayered photoreceptors containing charge transporting layers, adverse effects may be encountered during extended photoreceptor cycling. This can reduce the practical value of multilayered photoreceptors that are cycled many times in automatic devices such as electrophotographic copiers, duplicators and printers.

INFORMATION DISCLOSURE STATEMENT

U.S. Pat. No. 4,788,336 to Rule, issued Nov. 29, 1988,—An organic compound is disclosed having several specific formulae. The organic compound may comprise, for example, a carbon atom to which is attached two triarylamine moieties.

U.S. Pat. No. 5,093,698 to Egusa, issued Mar. 3, 1992—An organic electroluminescent device is disclosed which is constituted by first and second electrodes opposing each other and a multilayered body having a plurality of organic films sandwiched between the electrodes and including an electroluminescent layer. A donor impurity is doped in a first organic film in contact with the first electrode, and an acceptor impurity is doped in a second organic film in contact with the second electrode. A third organic film sandwiched between the first and second organic films serves as an electroluminescent layer. A material having a band gap narrower than those of the first and second organic films is selected as a material of the third organic film so as to confine carriers. No impurity is doped in the third organic film. The third organic film may contain an amine such as tri(4-ditorylaminophenyl)methane.

U.S. Pat. No. 5,294,810 to Egusa et al., issued Mar. 15, 1994,—An organic electroluminescent device is disclosed including first and second electrodes opposite to each other and a multi-layered body which is sandwiched between these electrodes and consists of a plurality of organic films including a light-emitting layer, a material for each organic film and electrode is selected so that electrons and holes are simultaneously and respectively injected from the first and second electrodes in the multi-layered body when a forward biasing voltage is applied, a large amount of injected electrons and holes are accumulated at the multi-layered body, and these electrons and holes are subjected to radiative recombination at a predetermined threshold voltage. The third organic film 6 of the plurality of organic films may contain an amine such as tri(4-ditorylaminophenyl)methane.

U.S. Pat. No. 5,554,450 to Shi et al., issued Sep. 10, 1996,—An organic electroluminescent device is disclosed which includes an anode and a cathode, and an electroluminescent element disposed between the anode and cathode. The organic electroluminescent element has at least one hole transport layer. The hole transport layer includes a polyaromatic amine represented by a specified formula. The amine formula includes a phenylene to which may be attached various groups including 3–6 triphenyl amine groups.

U.S. Pat. No. 4,806,443 to Yanus et al., issued Feb. 21, 1989—An electrophotographic imaging member and an electrophotographic process are disclosed in which the imaging member comprises a polymeric arylamine compound represented by a specific formula. The imaging member may comprise a substrate, charge generation layer and a charge transport layer. Activating small molecules such arylamine containing compounds are disclosed.

U.S. Pat. No. 4,818,650 to Limburg et al, issued Apr. 4, 1989—An electrostatographic imaging member and electrostatographic imaging process are disclosed in which the imaging member comprises a polymeric arylamine compound represented by a specific formula. Various activating small molecules are and polymeric arylamine molecules are mentioned.

U.S. Pat. No. 4,806,444 to Yanus et al., issued Feb. 21, 1989—An electrostatographic imaging member and electrostatographic imaging process are disclosed in which the imaging member comprises a polymeric arylamine compound represented by a specific formula. Various activating small molecule and polymeric arylamine compounds are mentioned U.S. Pat. No. 4,935,487 to Yanus et al., issued Jun. 19, 1990—A polymeric arylamine having a specific formula is disclosed. Various activating small molecule materials such as arylamine compounds and polymeric arylamine molecules are described.

U.S. Pat. No. 4,956,440 to Limburg et al., issued Sep. 11, 1990—Polymeric tertiary arylamine compounds of the phenoxy resin type are disclosed for electrophotographic imaging. Various activating small molecule materials such as arylamine compounds and polymeric arylamine molecules are described U.S. Pat. No. 4,801,517 to Frechet et al., issued Jan. 31, 1989—An electrostatographic imaging member and electrostatographic process are disclosed in which the imaging member comprises a polymeric arylamine compound having a specific formula. Various activating small molecule materials such as arylamine compounds and polymeric arylamine molecules are described.

U.S. Pat. No. 4,582,772 to Teuscher et al., issued Apr. 15, 1986—A photoresponsive device is disclosed comprising charge carrier transport layer comprising the combination of a resinous binder having dispersed therein small molecules of an electrically active arylamine small molecule.

U.S. Pat. No. 4,265,990, issued to Stolka et al. on May 5, 1981—A photosensitive member is disclosed having photoconductive layer and a charge transport layer, the charge transport layer containing an aromatic diamine in an inactive film forming binder.

U.S. Pat. No. 4,871,634 to Limburg et al., issued Oct. 3, 1989—A hydroxyl arylamine compound having a specific formula is disclosed. The arylamine compound may be employed in an electrophotographic imaging member and imaging process. Various activating small molecules and polymeric arylamine contain molecules are described. The hydroxyl arylamine may be bound by hydrogen binding to a resin capable of hydrogen bounding and incorporated into layers such as a charge transport layer.

CROSS REFERENCE TO COPENDING APPLICATIONS

Application Ser. No. 08/807,487, filed in the name of Nan-Xing Hu et al., entitled PHOTOCONDUCTIVE IMAGING MEMBERS, now U.S. Pat. No. 5,747,205—A photoconductive imaging member is disclosed comprised of a starburst aromatic amine compound having a specified formula. A nitrogen atom is positioned in the center of the specified aromatic amine compound formula. Each bond of the central nitrogen atom may attached, for example, through a biaryl group to another nitrogen atom of a diphenylamine.

Excellent toner images may be obtained with multilayered photoreceptors in which the charge transport layer contains a charge transporting polymer. However, it has been found that if a charge transporting polymer is mixed with a transporting small molecule in an inactive binder for a transport layer, xerographic performance is very poor as a result of trapping of carriers in the transport layer. This increases the residual potential, thus lowering the useful contrast potential. Furthermore when such a photoreceptor is cycled in a xerographic machine, a condition known as cycle-up results. The residual potential increases and causes the background area densities to increase thereby creating unacceptable images.

Thus, there is a continuing need for electrophotographic imaging members having improved electrical performance and resistance to degradation during extended cycling.

BRIEF SUMMARY OF THE INVENTION

It is, therefore, an object of the present invention to provide an improved electrophotographic imaging member which overcomes the above-noted disadvantages.

It is another object of the present invention to provide an electrophotographic imaging member which avoids crystallization at high concentrations of small molecule charge transport compounds It is still another object of the present invention to provide an electrophotographic imaging member exhibiting improved imaging operation during extended image cycling.

It is yet object of the present invention to provide an electrophotographic imaging member possessing improved integrity of layers underlying the charge transport layer.

It is still another object of the present invention to provide an electrophotographic imaging member that exhibiting greater wearability, hardness and craze resistance with high concentrations of charge transporting moieties in a charge transporting polymer.

It is another object of the present invention to provide an electrographic imaging member with high charge mobility.

It is yet another object of the present invention to provide an electrographic imaging member with reduced curl.

It is still another object of the present invention to provide an electrographic imaging member exhibiting higher glass transition temperature.

It is another object of the present invention to provide an electrophotographic imaging member which can be coated employing a variety of solvents.

It is still another object of this present invention to provide an electrophotographic imaging member containing either particle contact or dispersed pigment charge generator layers.

The foregoing objects and others are accomplished in accordance with this invention by providing an electrophotographic imaging member comprising a supporting substrate and at least one photoconductive layer, the photoconductive layer comprising a charge transporting material selected from the group consisting of six categories of organic aromatic polyarylamine materials. These six categories of polyarylamine materials are described in detail hereinafter. The at least one photoconductive layer may be a single photoconductive layer or comprise a combination of layers such as a charge generating layer and a charge transport layer. This imaging member may be utilized in an electrophotographic imaging process.

Electrostatographic imaging members are well known in the art. Electrostatographic imaging members may be prepared by various suitable techniques. Typically, a flexible or rigid substrate is provided having an electrically conductive surface. A charge generating layer is then applied to the electrically conductive surface. A charge blocking layer may be applied to the electrically conductive surface prior to the application of the charge generating layer. If desired, an adhesive layer may be utilized between the charge blocking layer and the charge generating layer. Usually the charge generation layer is applied onto the blocking layer and a charge transport layer is formed on the charge generation layer. However, in some embodiments, the charge transport layer is applied prior to the charge generation layer. If desired, instead of a dual layer system comprising separate charge generating and charge transport layers, a single photoconductive layer may be utilized, the single photoconductive layer containing both charge generating material and charge transport material.

The substrate may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. The electrically insulating or conductive substrate may be in the form of an endless flexible belt, a web, a rigid cylinder, a sheet and the like.

The thickness of the substrate layer depends on numerous factors, including strength desired and economical considerations. Thus, this layer for a flexible belt may be of substantial thickness, for example, about 125 micrometers, or of minimum thickness less than 50 micrometers, provided there are no adverse effects on the final electrostatographic device.

If the substrate is electrically conductive, it need not be coated with an electrically conductive coating. If the substrate is electrically insulating, it is usually coated with an electrically conductive layer. The electrically conductive layer may vary in thickness over substantially wide ranges depending on the optical transparency and degree of flexibility desired for the electrostatographic member. Accordingly, for a flexible photoresponsive imaging device, the thickness of the conductive layer may be between about 20 angstrom units to about 750 angstrom units, and more preferably from about 100 Angstrom units to about 200 angstrom units for an optimum combination of electrical conductivity, flexibility and light transmission. The flexible conductive layer may be an electrically conductive metal layer formed, for example, on the substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like.

After formation of an electrically conductive surface, a hole blocking layer may be applied thereto for photoreceptors. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino) titanate, titanium-4-amino benzene sulfonat oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane, as disclosed in U.S. Pat. No. 4,338,387, 4,286,033 and 4,291,110. The disclosures of U.S. Pat. Nos. 4,338,387, 4,286,033 and 4,291,110 are incorporated herein in their entirety. A preferred blocking layer comprises a reaction product between a hydrolyzed silane and the oxidized surface of a metal ground plane layer. The blocking layer may be applied by any suitable conventional technique such as spraying, dip coating, draw bar coating, gravure coating, silk screening, air knife coating, reverse roll coating, vacuum deposition, chemical treatment and the like. The blocking layer should be continuous and have a thickness of less than about 0.2 micrometer because greater thicknesses may lead to undesirably high residual voltage.

An optional adhesive layer may applied to the hole blocking layer. Any suitable adhesive layer well known in the art may be utilized. Typical adhesive layer materials include, for example, polyesters, duPont 49,000 (available from E.I. duPont de Nemours and Company), Vitel PE100 (available from Goodyear Tire & Rubber), polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

As described above, the electrically layers in a photoreceptor may comprise a dual electrically active layer system comprising separate charge generating and charge transport layers or a single electrically active photoconductive layer, the single photoconductive layer containing both charge generating material and charge transport material. In a single photoconductive layer system, photoconductive particles (charge generating material) are dispersed in a film forming binder and a charge transporting material dissolved or molecularly dispersed in the binder. Single photoconductive layer systems are well known in the art. To simplify and facilitate description of the description of the materials utilized in the single and dual active layer photoreceptors of this invention, the following is directed to dual active layer photoreceptors containing a charge generating (photogenerating) layer and a separate charge transport layer. However, the photoreceptors of this invention may comprise single active layer photoreceptors where the single active layer contains a charge transporting material selected from the group consisting of the six categories of organic aromatic polyarylamine materials described in detail below.

Any suitable photogenerating layer may be applied to the conductive surface or the s adhesive blocking layer. The photogenerating layer can then be overcoated with a contiguous hole transport layer as described hereinafter. Examples of typical photogenerating layers include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free, metal phthalocyanines such as vanadyl phthalocyanine and copper phthalocyanine, dibromoanthanthrone, squarylium, quinacridones, dibromo anthanthrone, benzimidazole perylene, substituted 2,4-diamino-triazines, polynuclear aromatic quinones, and the like dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure of this patent being incorporated herein by reference. Other suitable photogenerating materials known in the art may also be utilized, if desired.

Any suitable polymeric film forming binder material may be employed as a matrix in the photogenerating binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyvinyl acetals, polyamides, polyimides, amino resins, phenylene oxide resins, terephthalic acid resins, phenoxy resins, and the like.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer containing photoconductive compositions and/or pigments and the resinous binder material generally ranges in thickness of from about 0.1 micrometer to about 5.0 micrometers, and preferably has a thickness of from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

Any suitable and conventional technique may be utilized to mix and thereafter apply the photogenerating layer coating mixture. Typical application techniques include spraying, dip coating, roll coating, wire wound rod coating, and the like. Drying of the deposited coating may be effected by any suitable conventional technique such as oven drying, infra red radiation drying, air drying and the like.

If desired, the charge generating layer may be homogenous and contain only photoconductive material such as many of the materials listed above for the photogenerating pigments. Homogeneous layers may be prepared, for example, by vacuum deposition.

The charge transport layer of one embodiment of the photoreceptor of this invention or the single active photoconductive layer of another embodiment of the photoreceptor of this invention comprises a charge transporting material selected from the group consisting of the following six categories of organic aromatic polyarylamine materials:

The first of the six categories is a charge transporting organic aromatic polyarylamine selected from the group consisting compounds represented by the following formulae:

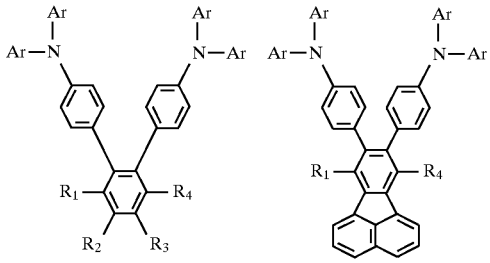

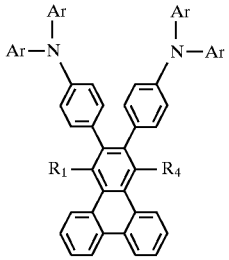

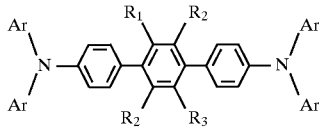

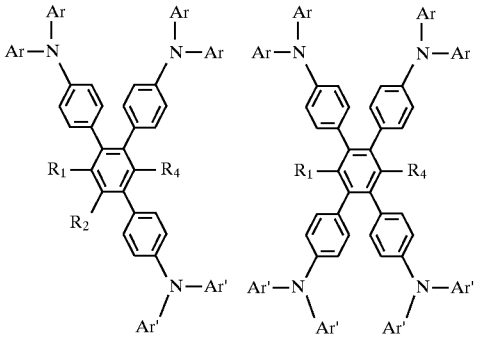

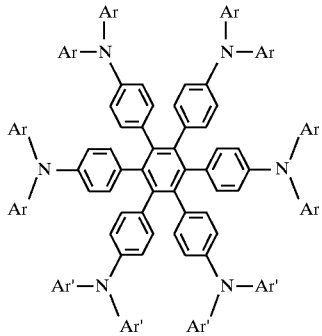

-continued

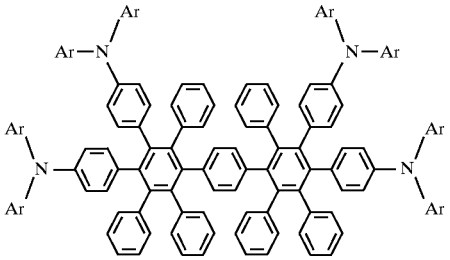

wherein:

$R_1$, $R_2$, $R_3$, $R_4$ are independently selected from the group consisting of substituted or unsubstituted alkyl groups containing from 1 to 24 carbon atoms and substituted or unsubstituted aromatic groups, if at least one of $R_1$, $R_2$, $R_3$, $R_4$ is:

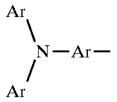

then at least one other of $R_1$, $R_2$, $R_3$, $R_4$ is:

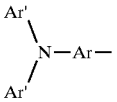

Ar and Ar' are substituted or unsubstituted aromatic groups and Ar is different from Ar';

Typical preferred organic polyarylamine charge transporting for the first category represented by the above formula are illustrated in formulae below. This first category of organic polyarylamine charge transporting molecule may be prepared by reacting (1) a cyclopentadienone compound and dienophile containing compound, at least one of which contains two identical triarylamine groups or (2) reacting a dibromo or diiodo compound with a least two equivalents of a diarylamine compound in the presence of a catalyst selected from the group consisting of copper, nickel and palladium. The resulting charge transporting polytriarylamine molecules contain at least two triarylamine units in each molecule. Many cyclophentadienones and dienophiles described in "M. A. Ogliaruso, M. G. Romanelli and E. I. Backer Chemical Reviews, vol. 65, p261–367", this entire review being incorporated herein by reference.

Preferred dienophile compounds include, but are not limited to, illustrative compounds having the following structures:

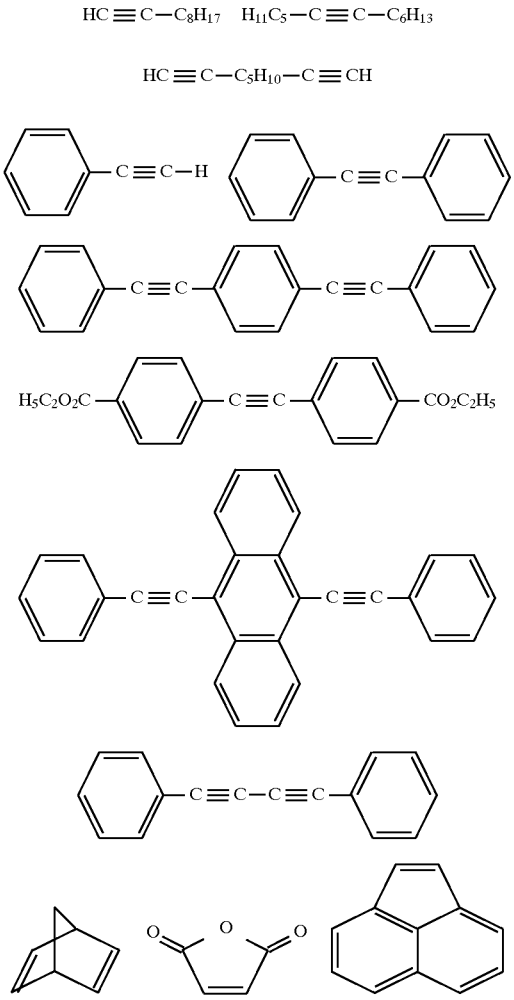

Preferred cyclopentadienone compounds include, but are not limited to, illustrative compounds having the following structures:

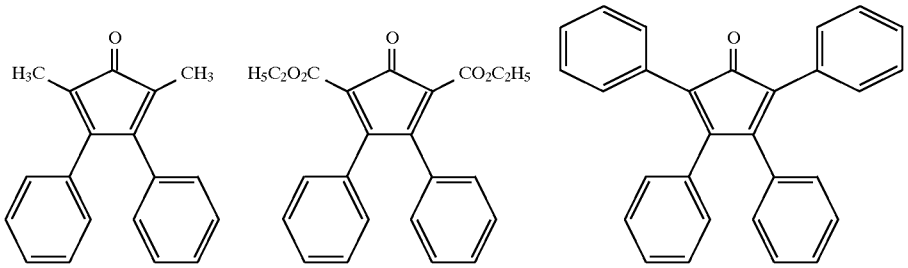

-continued

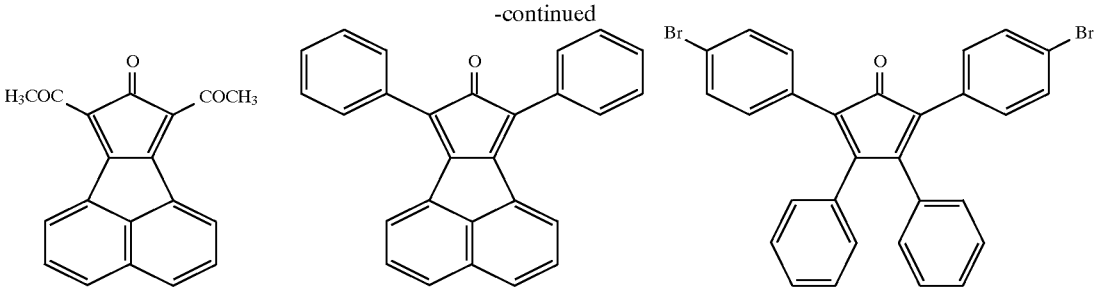

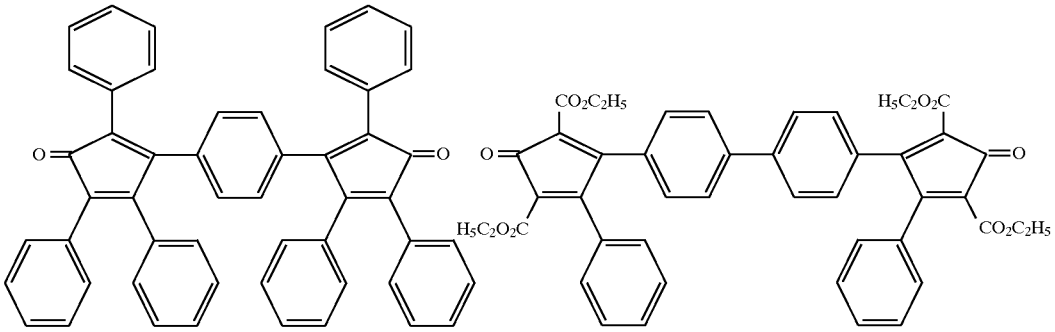

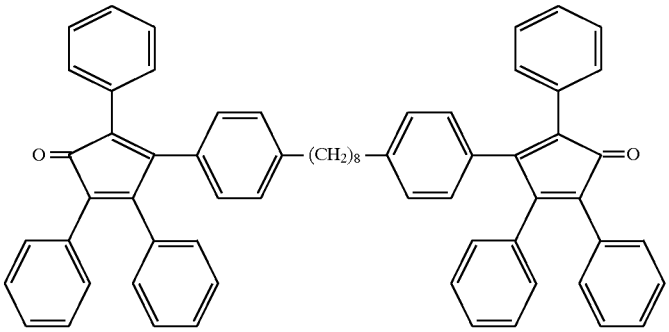

Typical structures for triarylamines with acetylene groups are shown below:

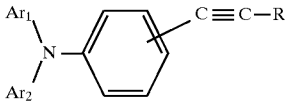

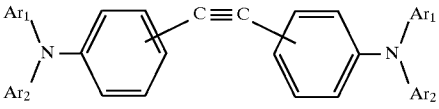

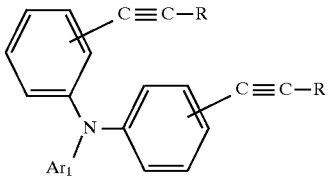

-continued

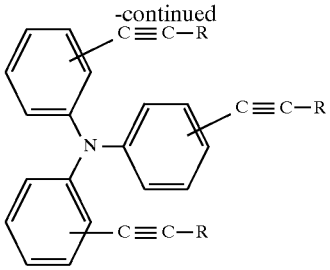

wherein in the above formulae:

R is selected from the group consisting of an alkyl group containing from 1 to 24 carbon atoms and an aromatic group, and $Ar_1$, $Ar_2$ are aromatic groups. Typical aromatic groups include, for example, phenyl, tolyl, bromophenyl, naphthyl and the like.

Typical structures for triarylamines with cyclopentadienone groups are shown below:

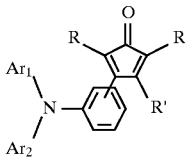

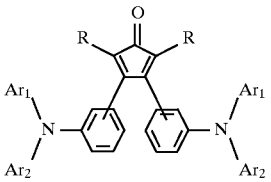

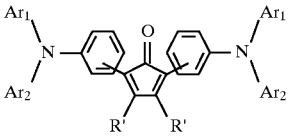

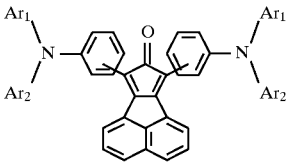

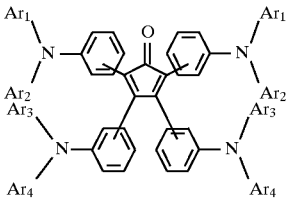

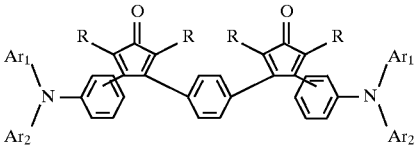

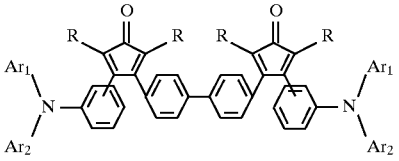

wherein in the above formulae:

R and R' is selected from the group consisting of an alkyl group containing from 1 to 24 carbon atoms and an aromatic group, and $Ar_1$, $Ar_2$ are aromatic groups. Typical aromatic groups include, for example, phenyl, tolyl, bromophenyl, naphthyl and the like.

Typical preferred triarylamine compounds containing acetylene groups are exemplified by, but not limited to those shown below:

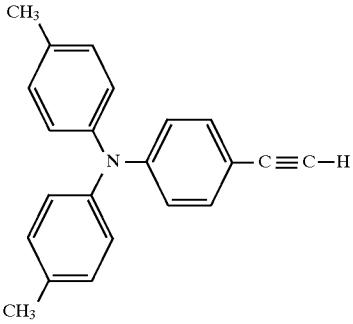

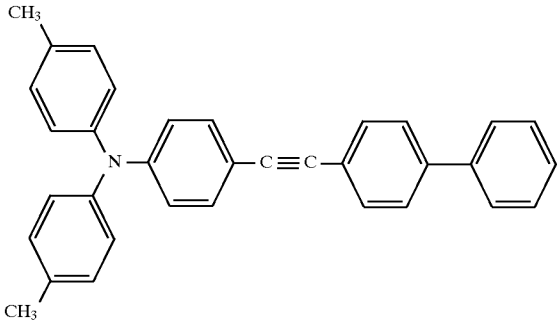

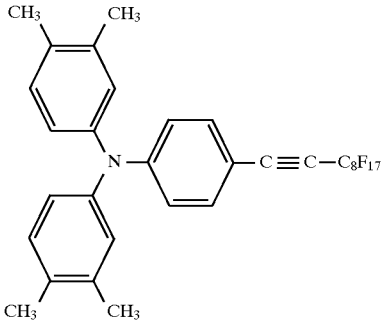

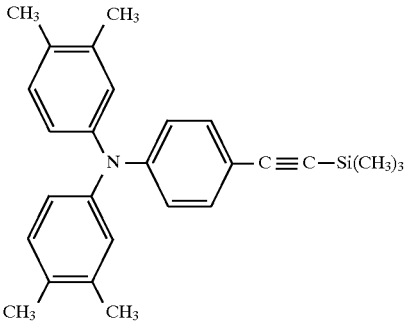

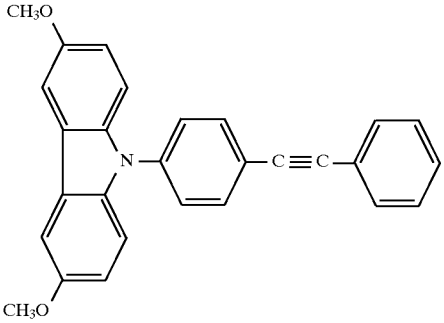

-continued

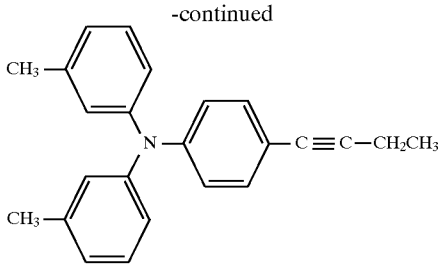

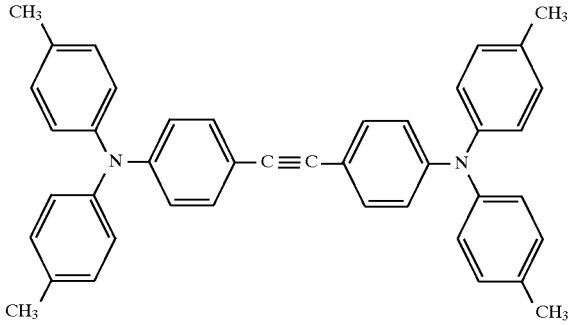

Typical preferred triarylamine compounds containing cyclopentadienone groups are exemplified by, but not limited to those shown below:

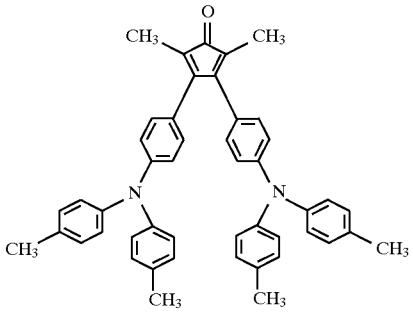

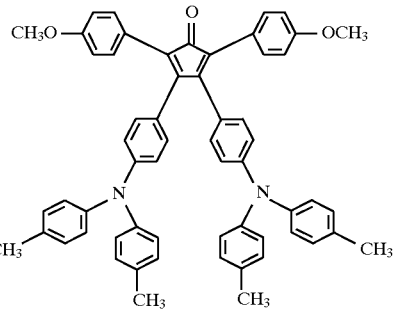

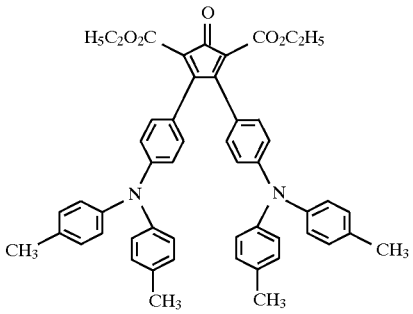

-continued

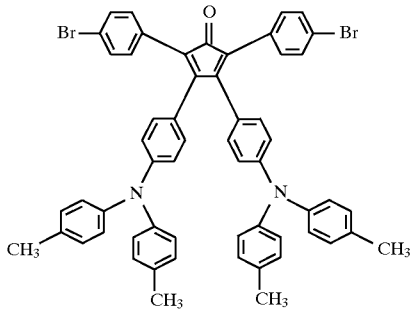

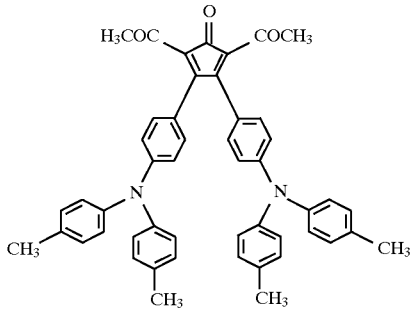

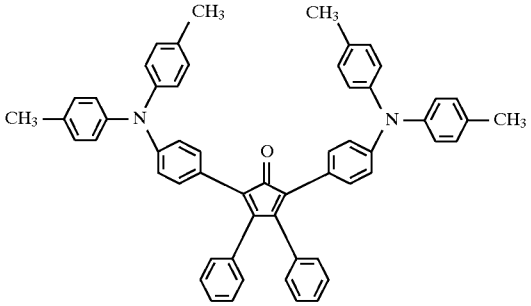

The Diels-Alder reaction for preparing the third type of organic polyarylamine charge transporting material of this invention can be performed under any suitable inert atmosphere. Typical inert atmospheres include, for example, nitrogen, argon and the like. If desired, the reaction may be conducted at or above atmospheric pressure in bulk or in a solvent. Typical pressures range from between about 2 and about 350 times atmospheric pressure. The reaction may be performed in a bomb or a sealed tube at a temperature between about of 50° C. and about 350° C. or preferably between 100° C. and about 250° C. for between about 1 hour and about 1 week. The resulting organic polyarylamine charge transporting molecules contain at least two triarylamine type charge transport groups in each molecule as shown in the following illustrative examples:

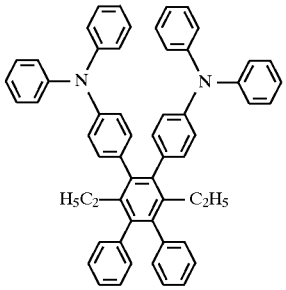

-continued
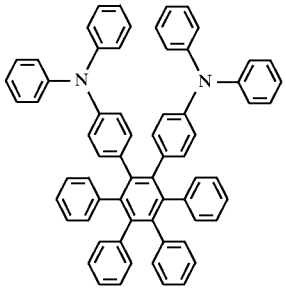
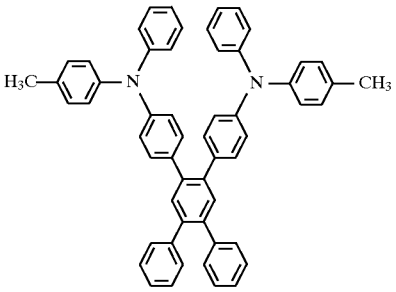
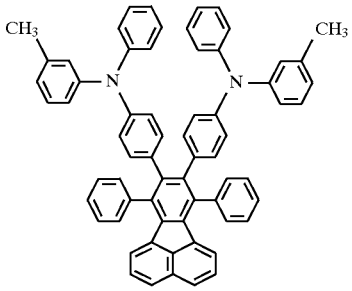
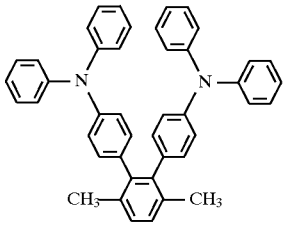
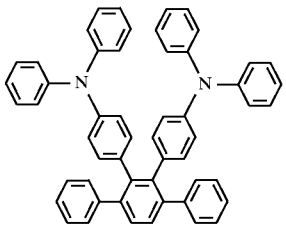
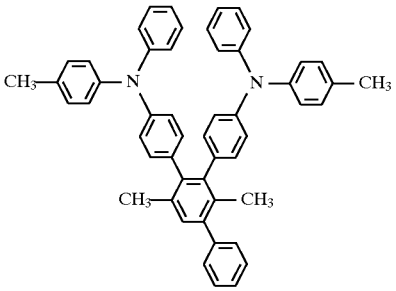
-continued
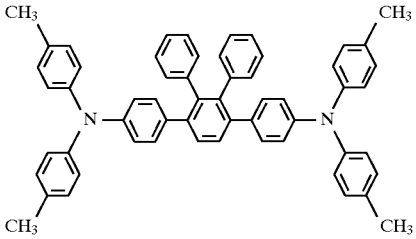
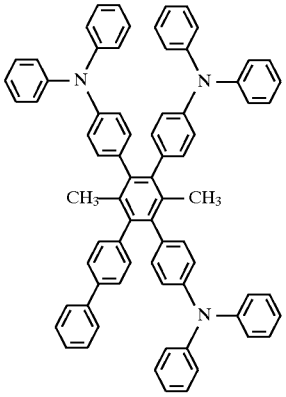
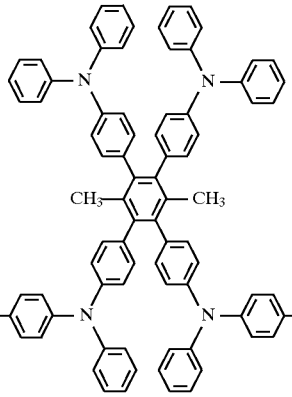
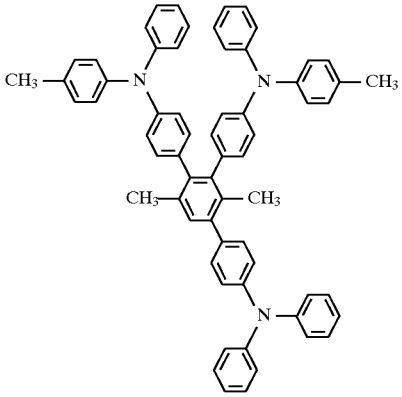

-continued
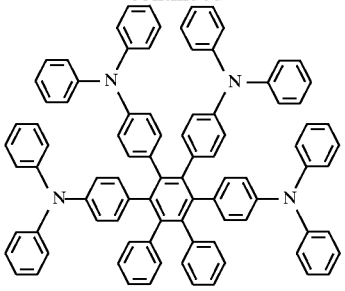
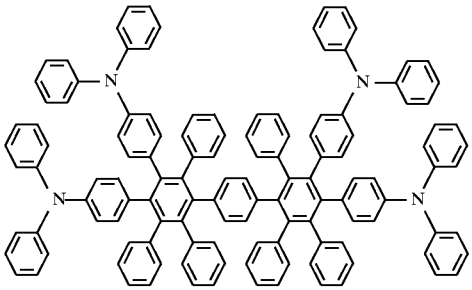
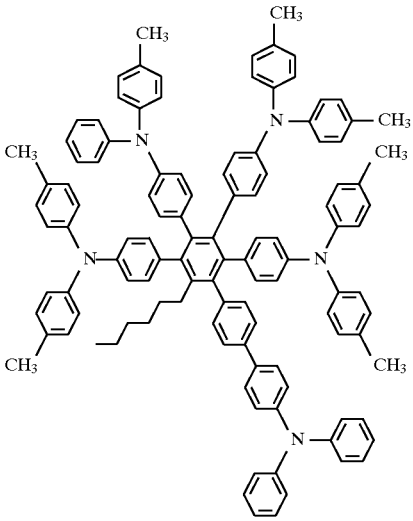
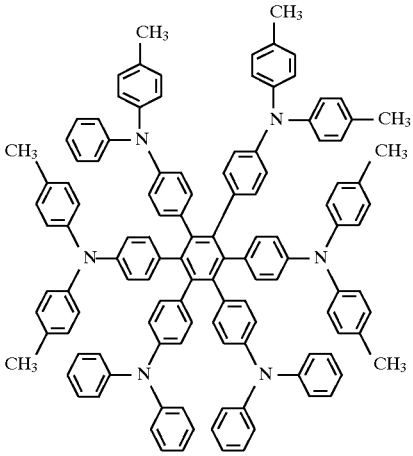
The second of the six categories of charge transporting organic aromatic polyarylamine materials used in the photoreceptor of this invention is selected from the group consisting of compounds having two polymerizable functional groups represented by the following formulae:
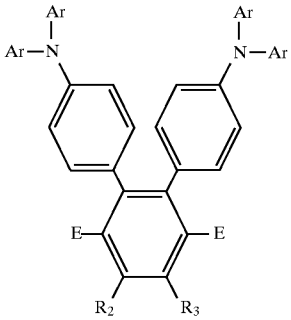
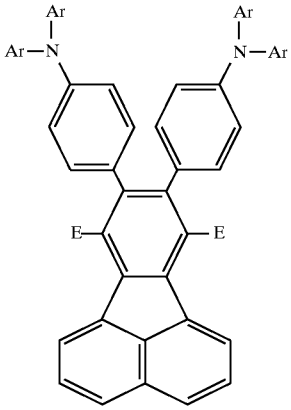
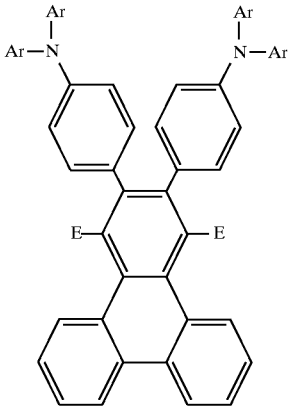
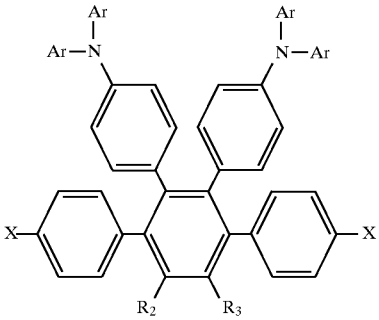

-continued

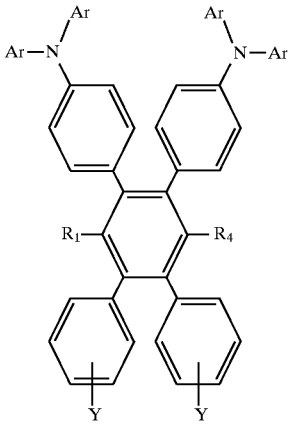

wherein:

$R_2$ and $R_3$ are independently selected from the group consisting of substituted or unsubstituted alkyl groups containing from 1 to 24 carbon atoms and substituted or unsubstituted aromatic groups, E is selected from the group consisting of methyl ester, ethyl ester and acetyl groups and X and Y are selected from the group consisting of OH, Cl, Br and I.

The second of the six categories of this invention also include polyarylamine charge transporting polymers prepared from polyarylamine charge transporting molecules containing two polymerizable functional groups such as dicarboxylic acid groups, dicarboxylic acid groups, dialkylester groups, dihydroxy groups and dihalogen groups as shown below in illustrative examples:

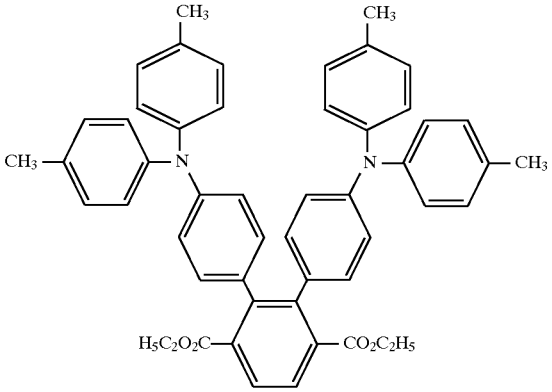

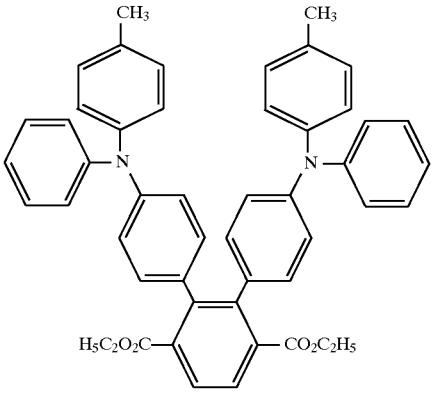

-continued

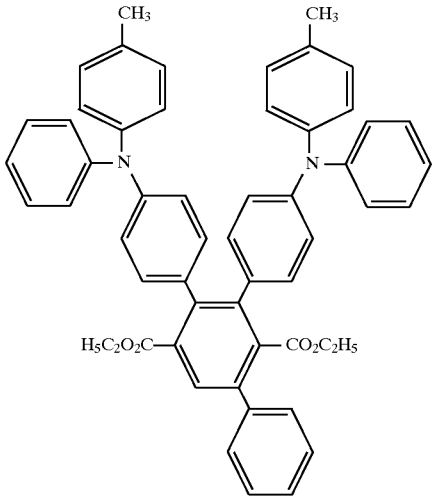

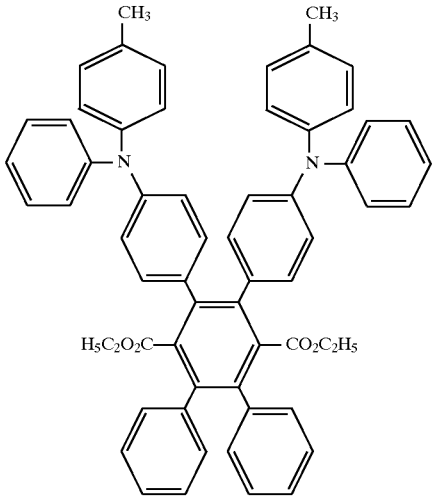

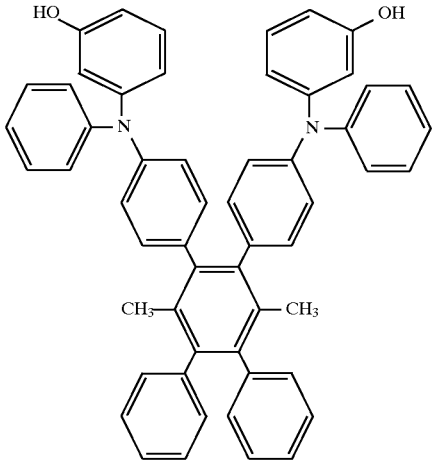

-continued

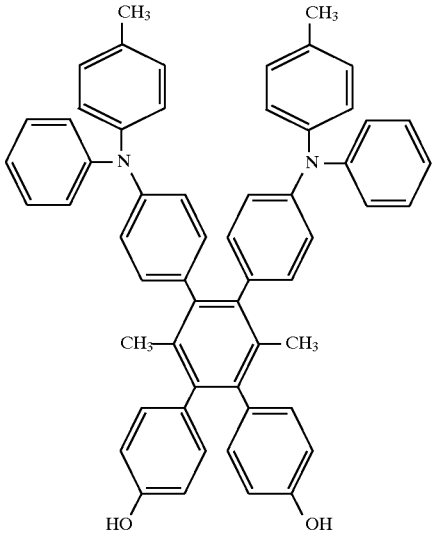

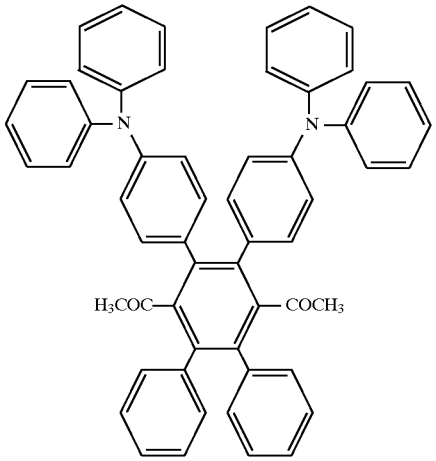

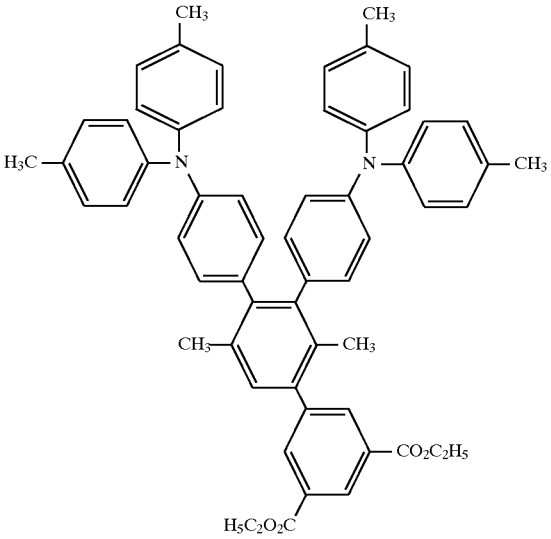

These organic polyarylamine charge transporting molecules containing polymerizable functional groups selected from the group consisting of dicarboxylic acid and dicarboxylic acid dialkylester groups are subjected to condensation polymerization with a bisphenol or a diamine type monomer to give a polyester or a polyamide respectively. Those molecules containing polymerizable functional dihydroxy groups can undergo polymerization with (1) phosgene to form a polycarbonate or (2) a diacid or a diester to form a polyester.

The organic polyarylamine charge transporting molecules resulting from the Diels-Alder reactions described above may also contain polymerizable functional dihalogen groups, such as Cl, Br, and 1. Typical molecules are illustrated below:

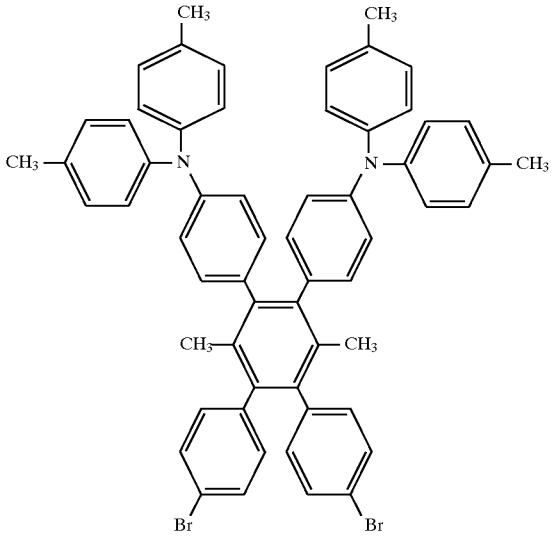

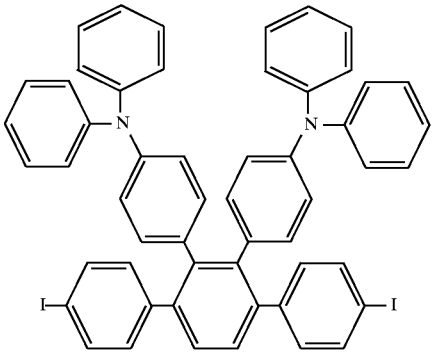

These types of organic polyarylamine charge transporting molecules containing dihalogen groups can undergo metal catalyzed self-polymerization or with a diboronic acid type monomer give conjugated organic polyarylamine charge transporting polymers.

The third, fourth and fifth categories of the organic polyarylamine charge transporting material of this invention are selected from the group consisting compounds represented, respectively, by the immediately following formulae:

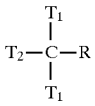

-continued

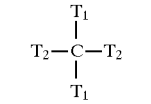

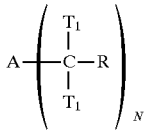

wherein:

$T_1$ and $T_2$ are selected from the group consisting of

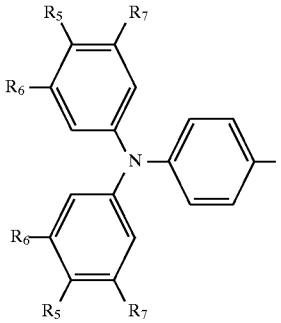

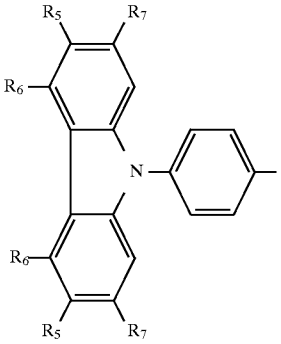

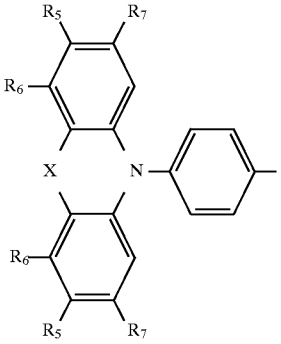

and $T_2$ can alternatively be selected from the group consisting of

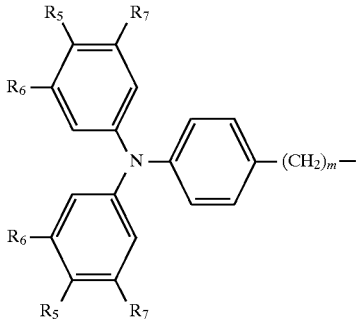

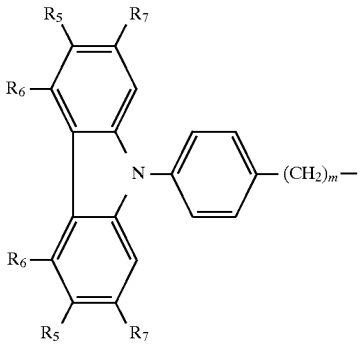

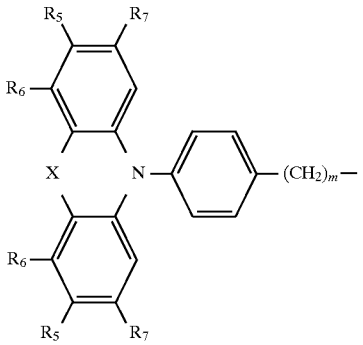

wherein

R is selected from the group consisting of hydrogen, substituted or unsubstituted alkyl groups containing from 1 to 12 carbon atoms, and substituted or unsubstituted aromatic groups, N is an integer from 2 to 6, X is selected from the group consisting of O, S, or $CH_2$, A is a connecting aromatic group for $(C(T_1)_2\text{-}R)$ groups, when N is 2, A is selected from the group consisting of

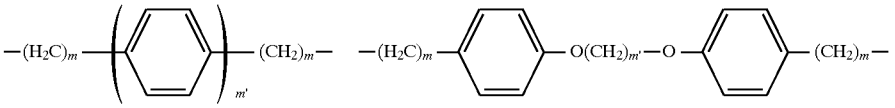

-continued
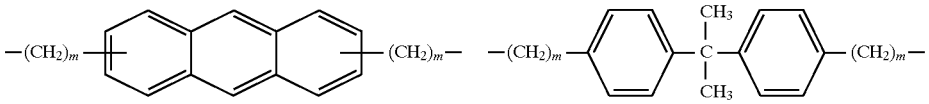
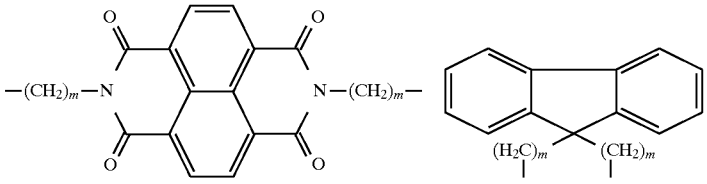
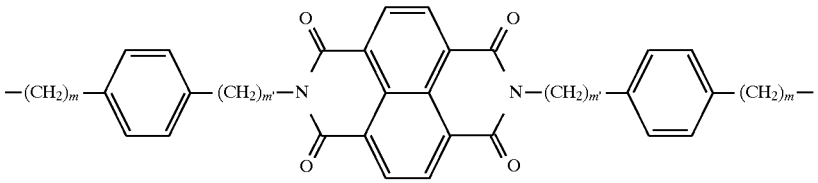
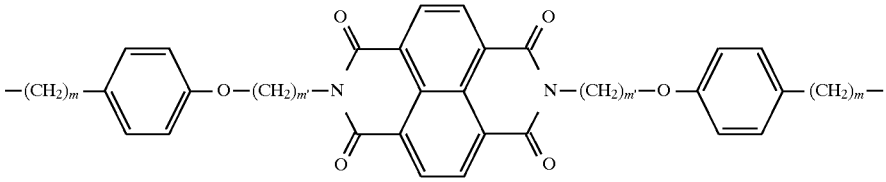
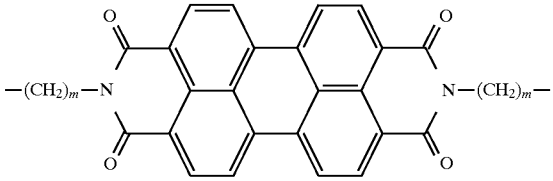
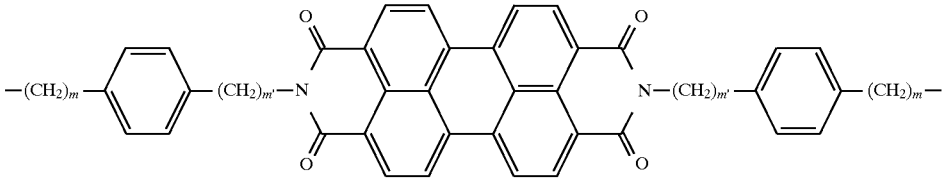
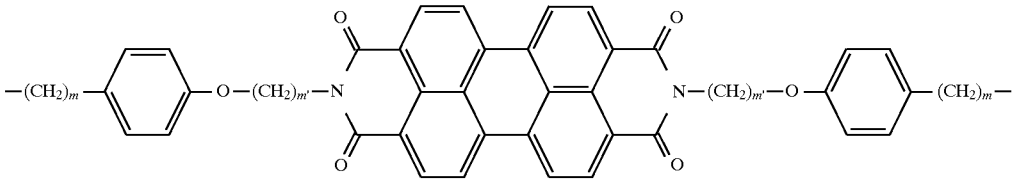
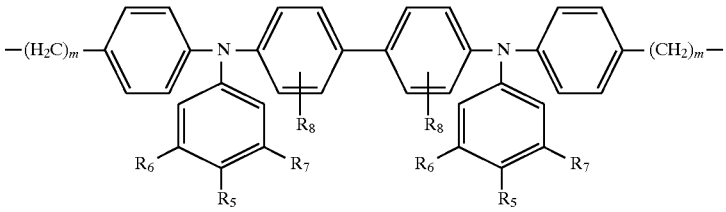

-continued
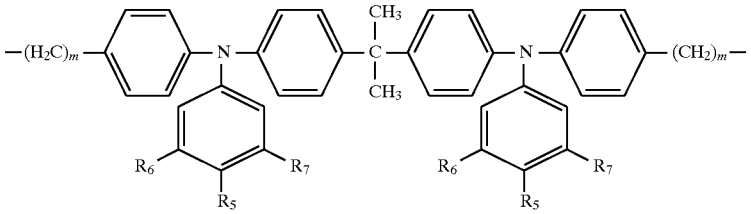
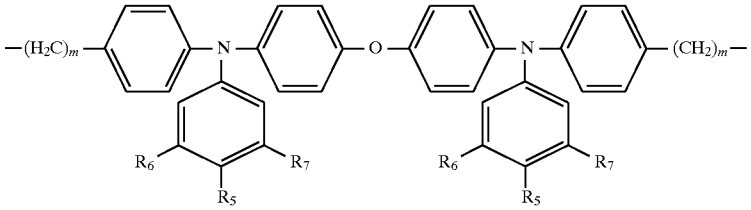
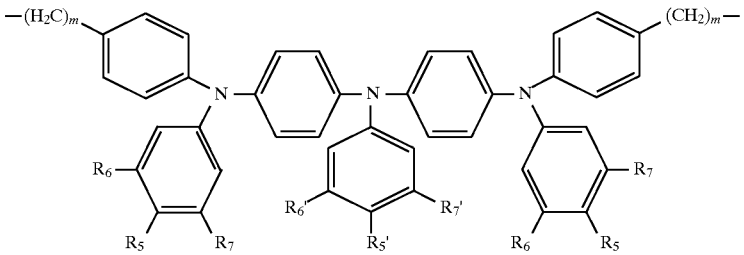
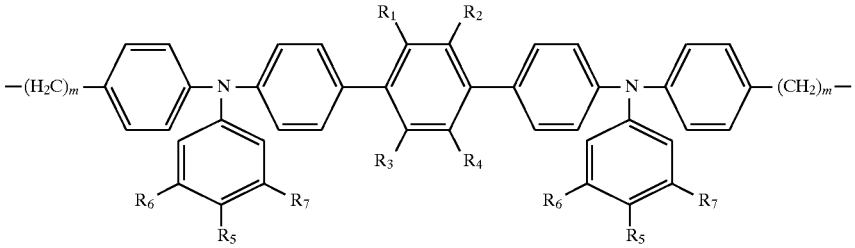
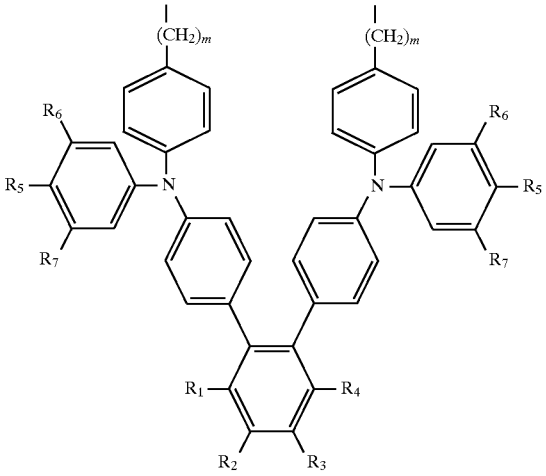

-continued
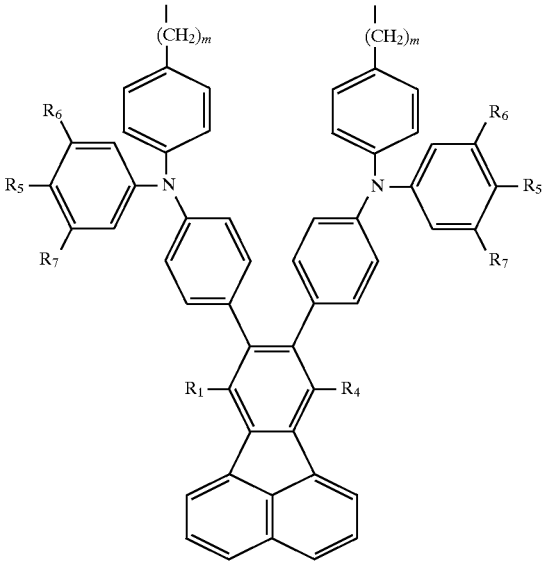
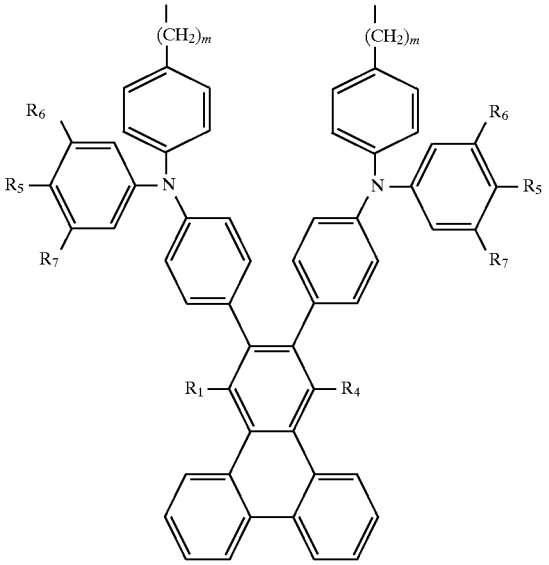
when N is 3, A is selected from the group consisting of
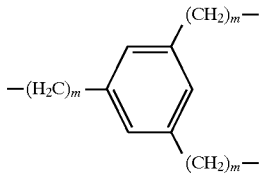
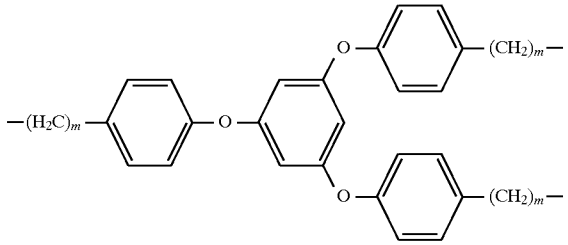

-continued
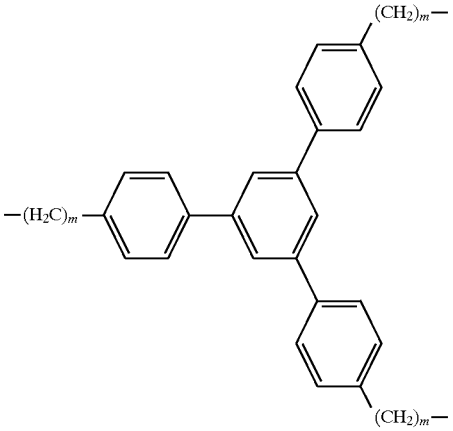
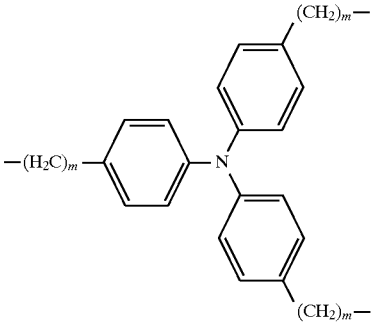
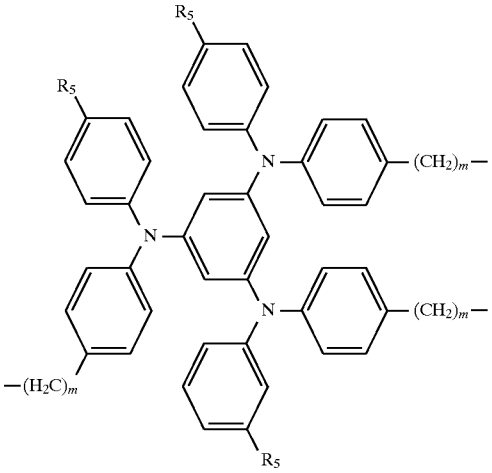

-continued
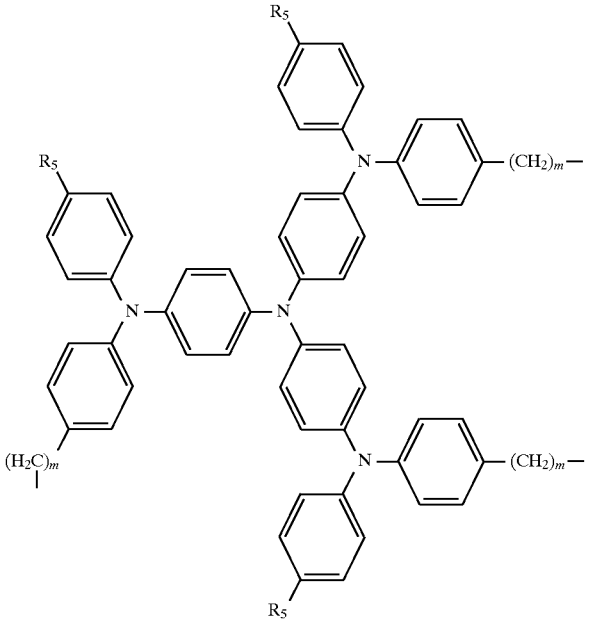
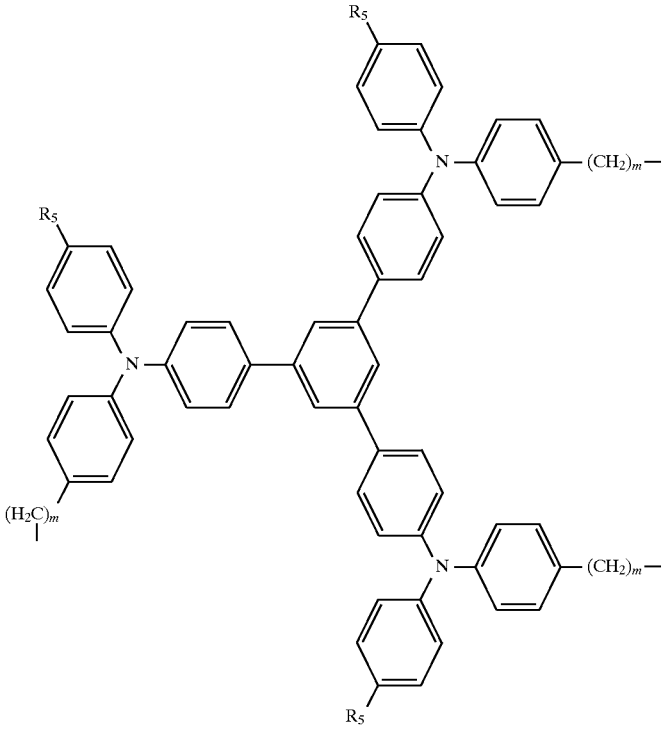
when N is 4, A is selected from the group consisting of
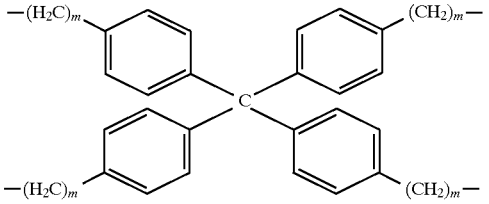
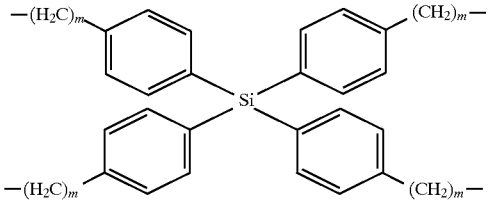

-continued
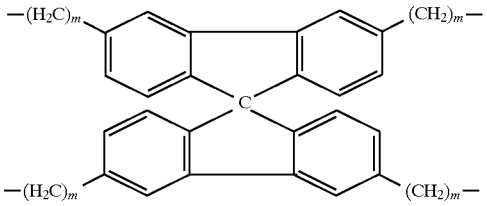
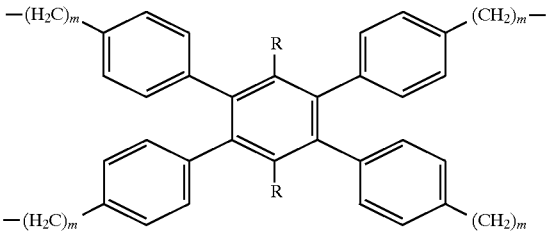
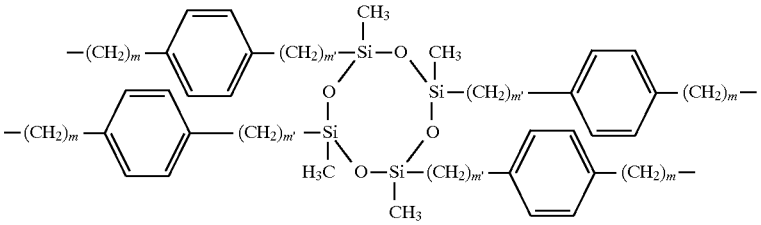
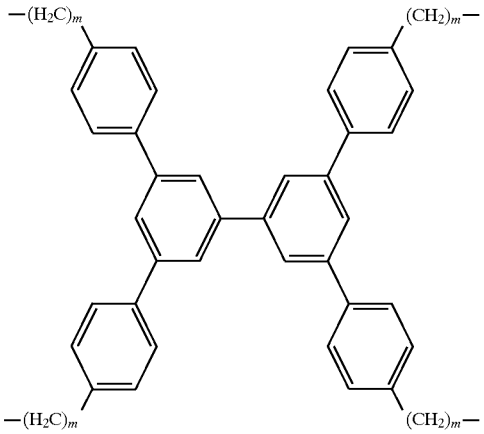
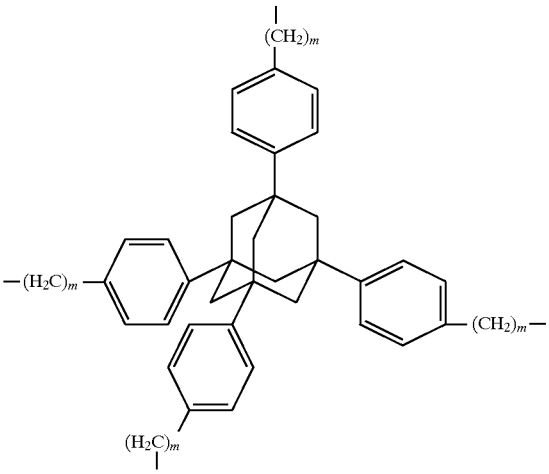
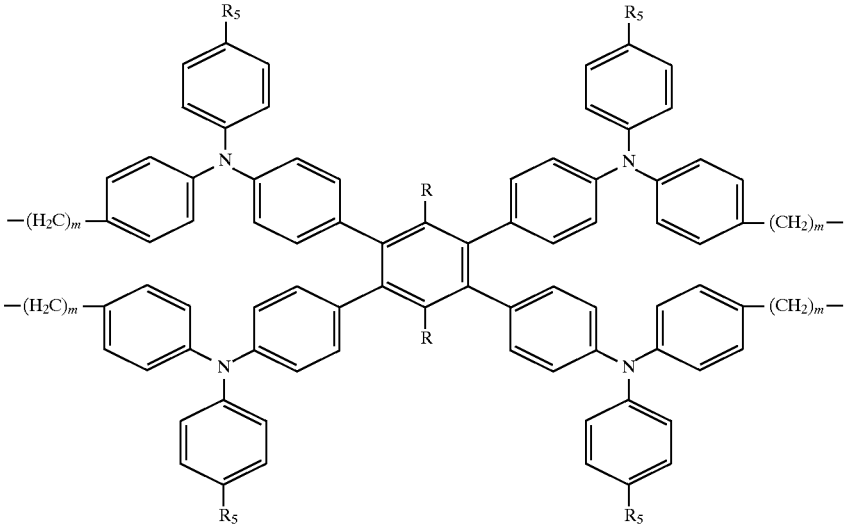

-continued
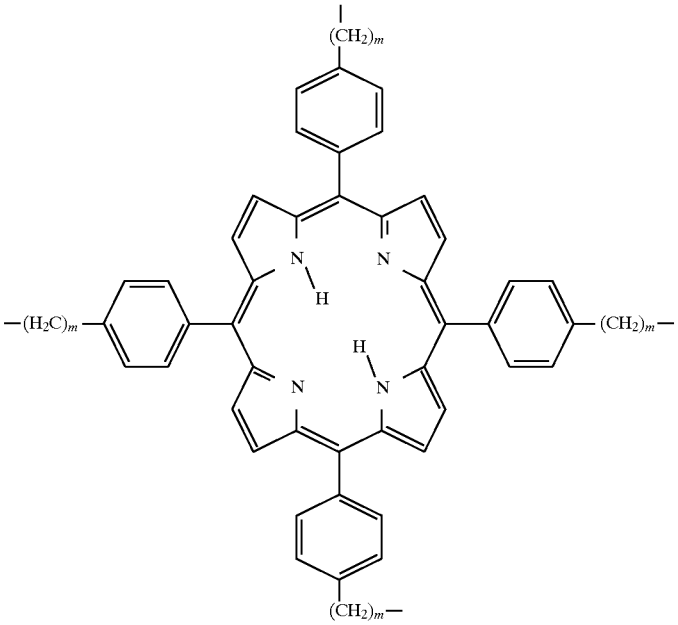
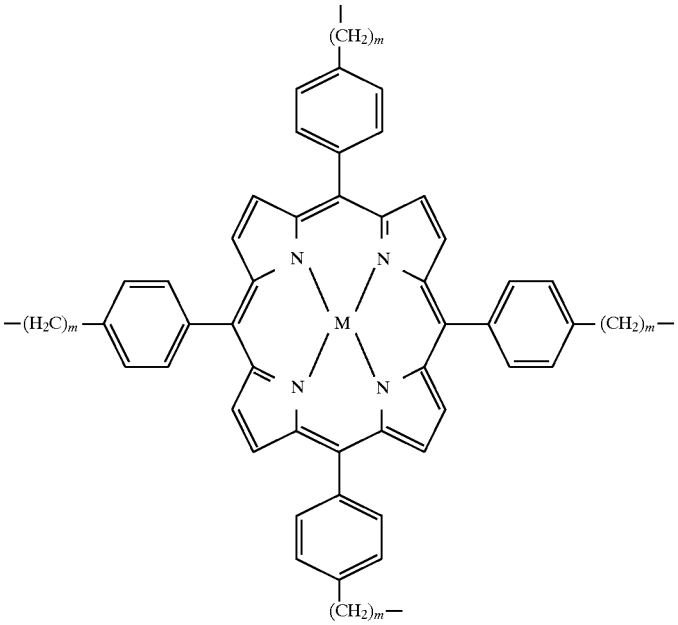
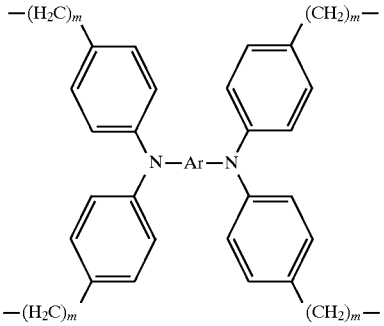
when N is 6, A is selected from the group consisting of

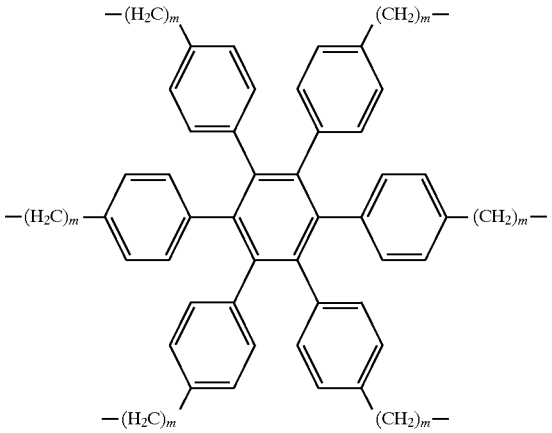
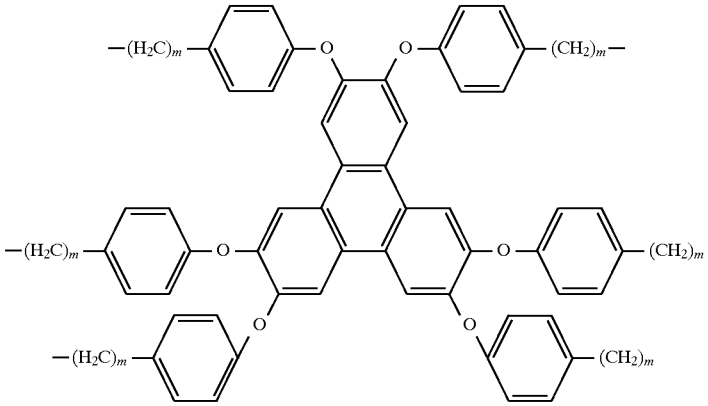
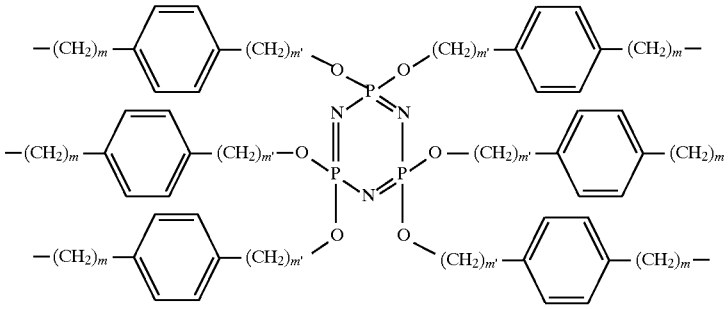
when N is 8, A is
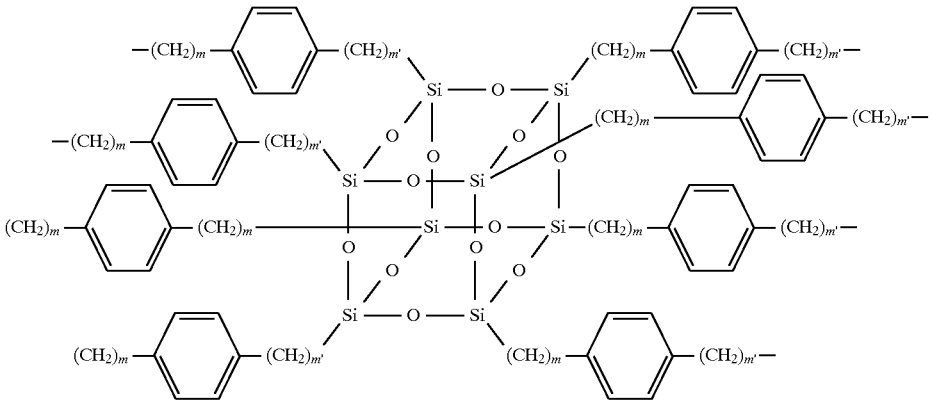

wherein m and m' are integers from 0 to 12; $R_5$ and $R_5'$ are alkyl groups containing 1 to 24 carbon atoms; R, $R_1$, $R_2$, $R_3$, $R_4$, $R_6$, $R_6'$, $R_7$, $R_7'$, $R_8$ are selected from the group consisting of hydrogen, halogen, alkyl group containing 1 to 24 carbon atoms and aromatic groups, M is a divalent metal ion; and Ar is an aromatic group selected from the group consisting of:

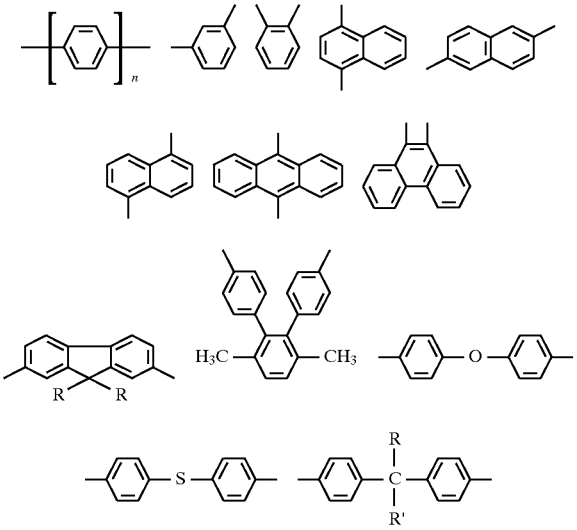

-continued

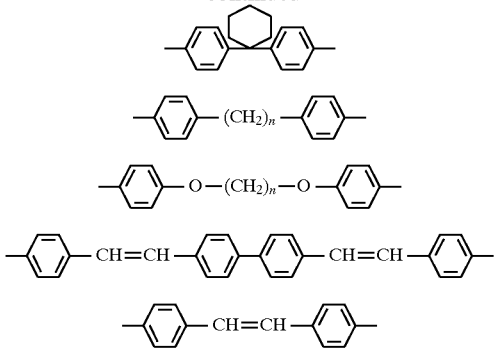

wherein n is an integer from 1 to 12 and R and R' are alkyl groups containing 1 to 12 carbon atoms.

The third, fourth and fifth categories of the organic polyarylamine charge transporting material of this invention, as represented by the above formulae, may be prepared by a process involving an acid catalyzed condensation reaction between a carbonyl compound and a triarylamine charge transport compound to give a polyarylamine compound of the present invention.

The preferred carbonyl compound reactants include, for example, monocarbonyl, dicarbonyl, tricarbonyl, tetracarbonyl, hexacarbonyl compounds. Typical preferred carbonyl compounds are illustrated by the formulae below:

Monocarbonyl compounds

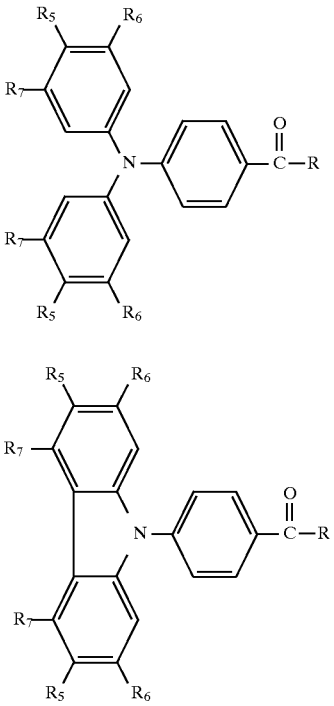

-continued
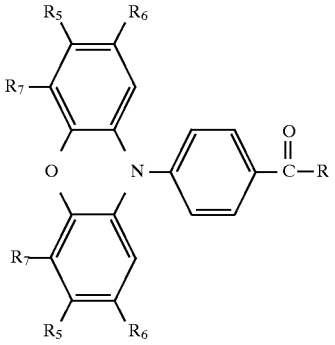
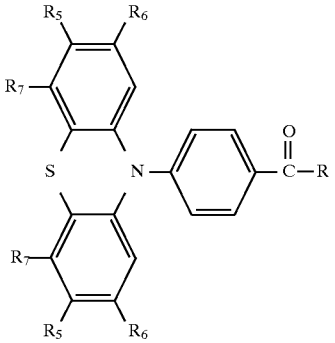
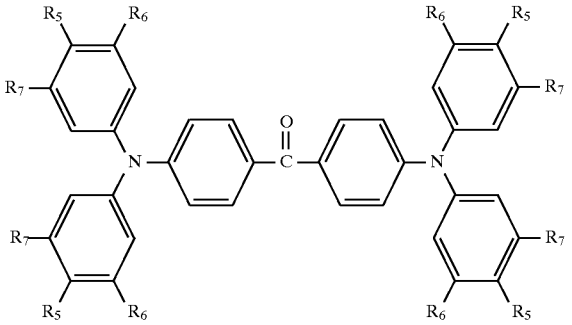
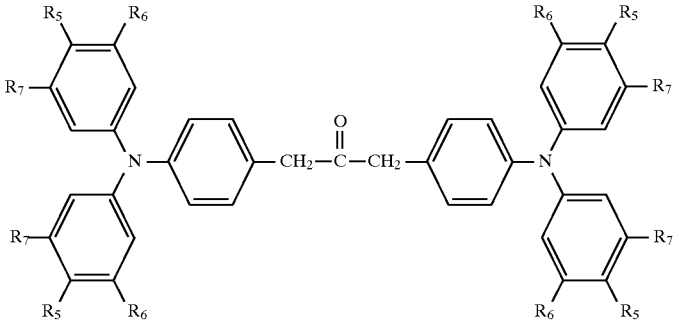
Dicarbonyl compounds
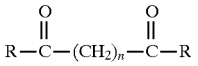
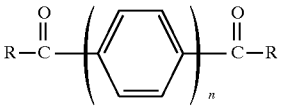

-continued
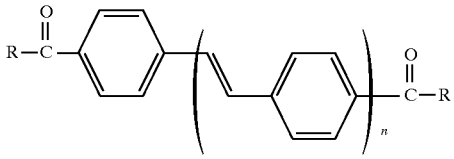
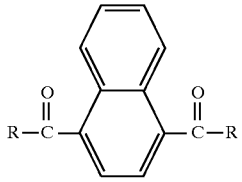
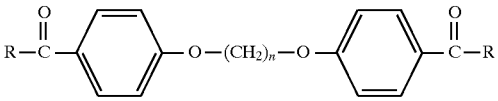
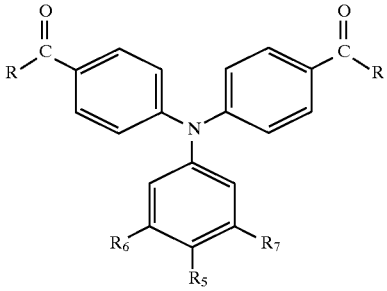
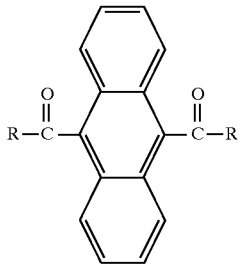
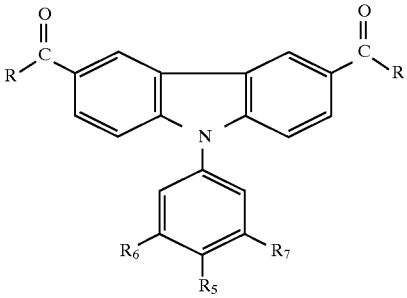
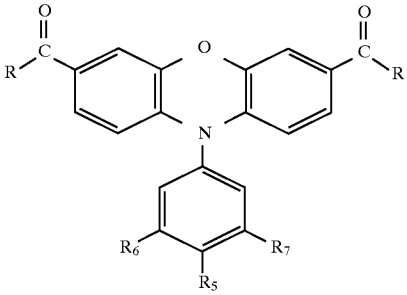

-continued
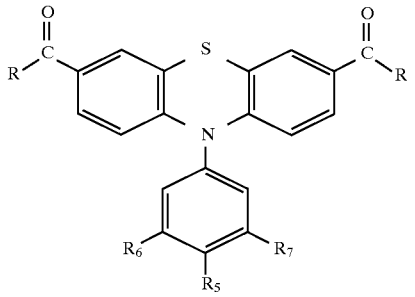
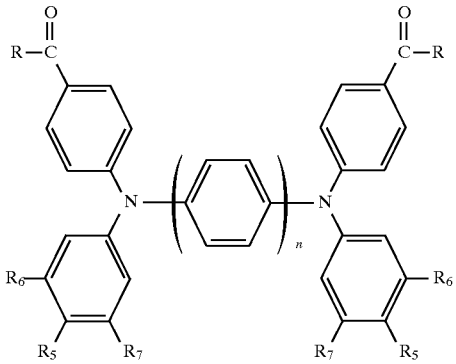
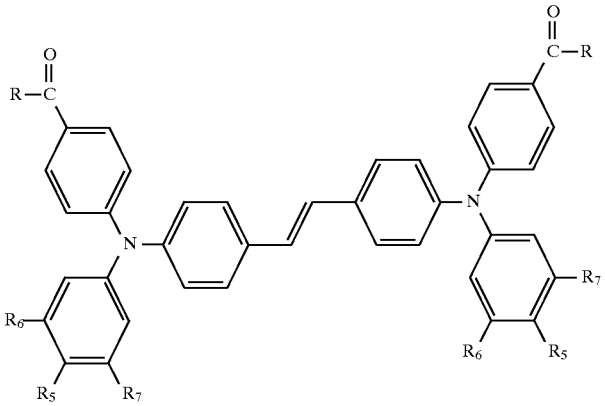
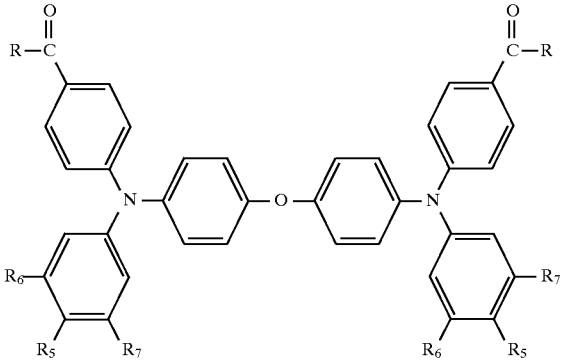

-continued
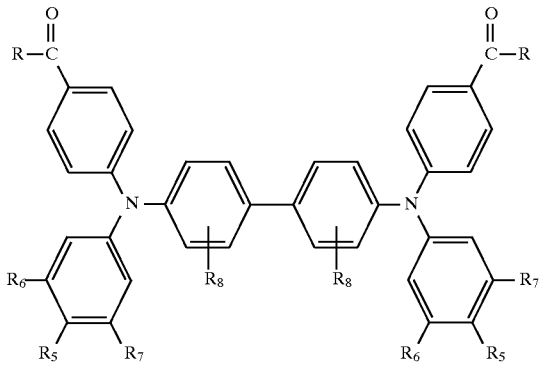
Tricarbonyl compounds
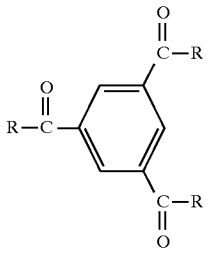
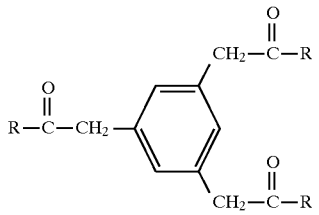
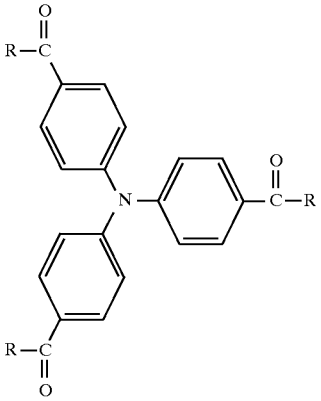

-continued
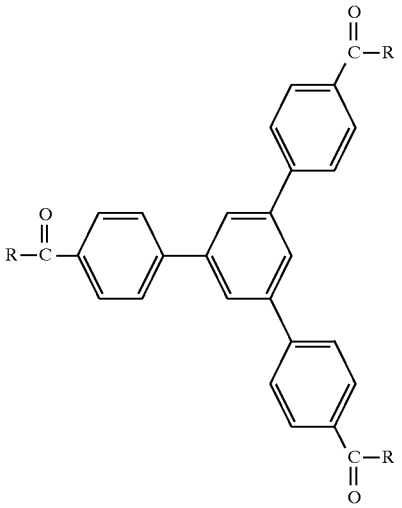
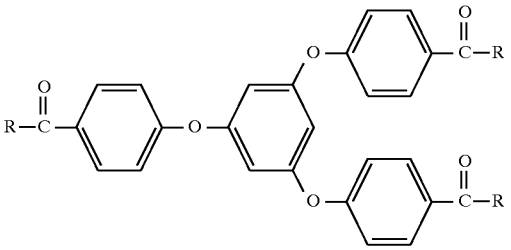
Tetracarbonyl compounds
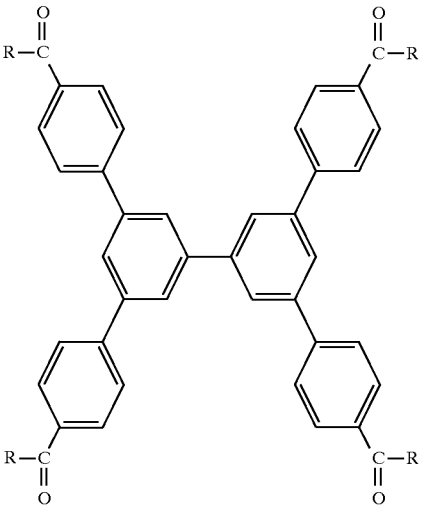

-continued
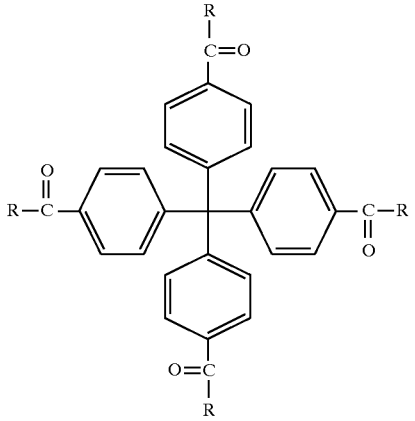
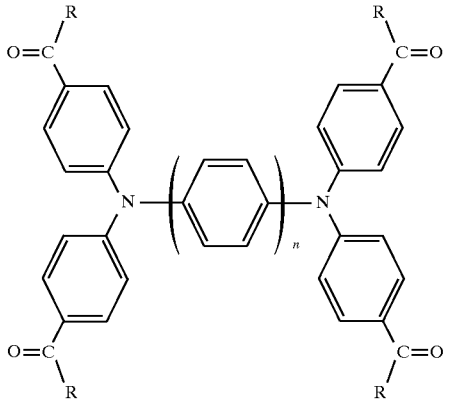
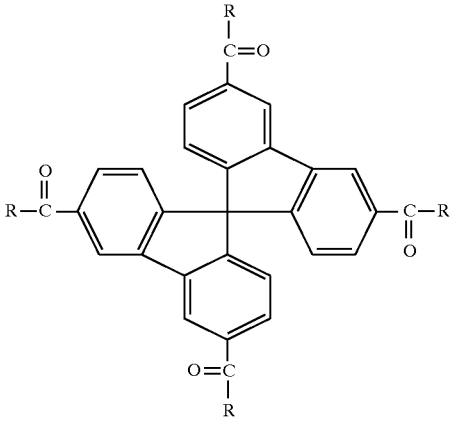
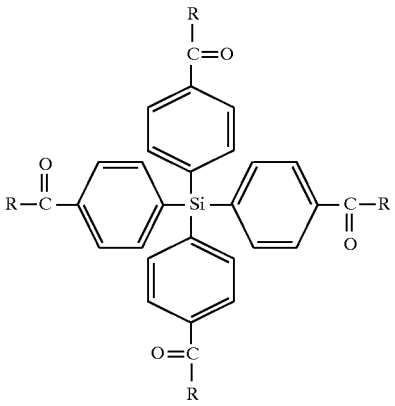

-continued
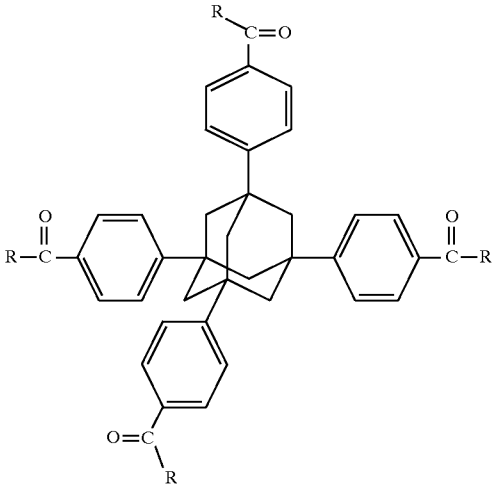
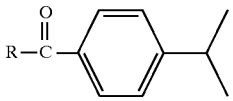
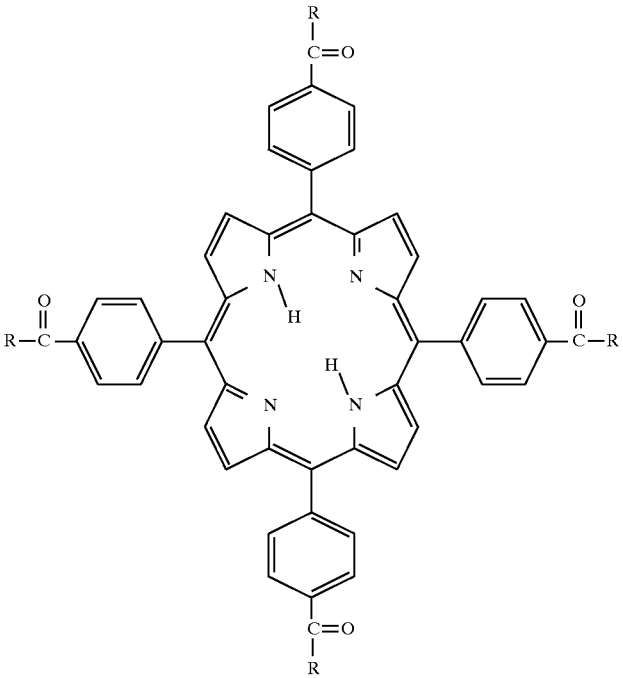

-continued
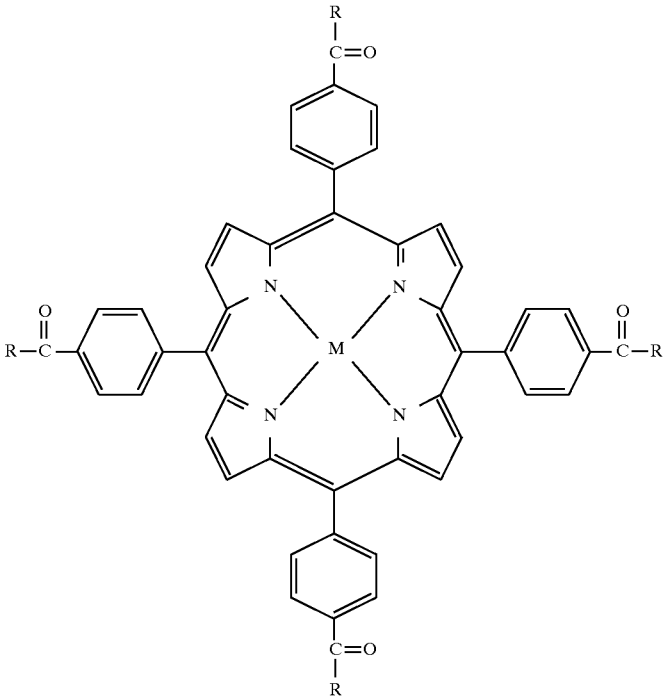
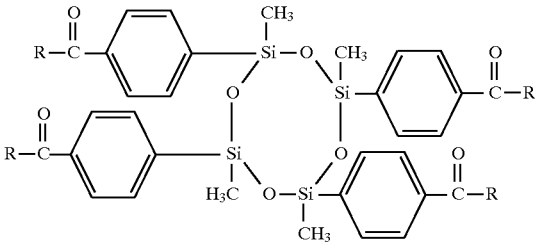
Hexacarbonyl compounds
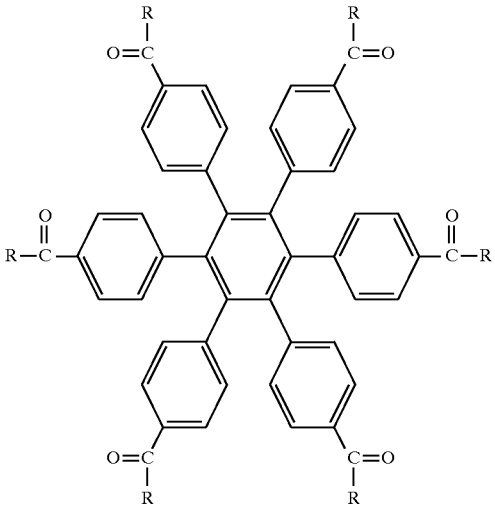

-continued

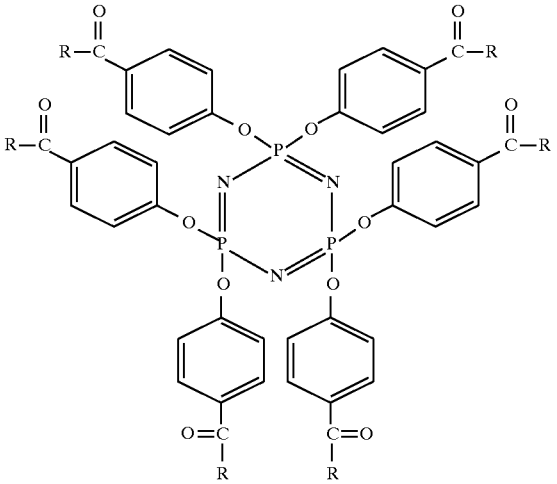

Octacarbonyl compounds

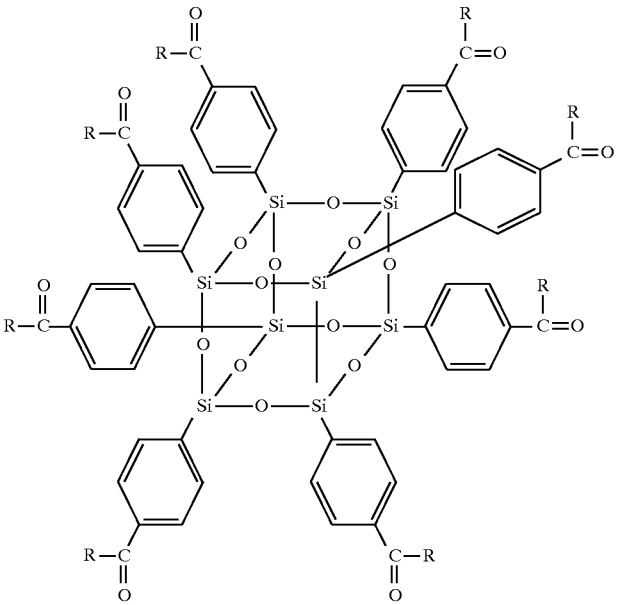

wherein in the above formulae:

R is selected from the group consisting of hydrogen, substituted or unsubstituted alkyl groups containing from 1 to 12 carbon atoms, M is a divalent metal ion, and substituted or unsubstituted phenyl group, $R_5$ is selected from the group consisting of an alkyl group containing from 1 to 24 carbon atoms, an aromatic group, chlorine, and bromine, $R_6$, $R_7$ and $R_8$ are independently selected from the group consisting of hydrogen, an alkyl or aromatic group, chlorine and bromine.

Typical preferred triarylamine charge transport compounds are illustrated in the formulae below:

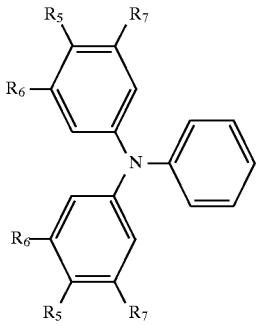

-continued

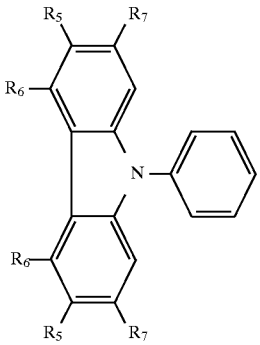

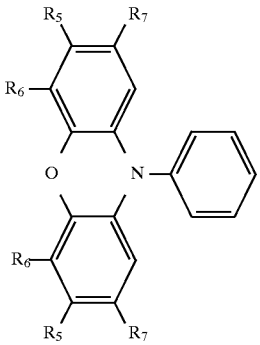

-continued

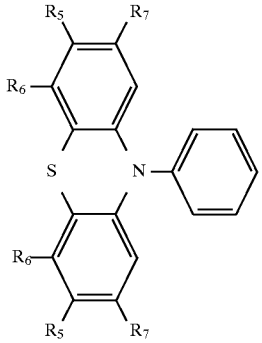

$R_5$ is selected from the group consisting of an alkyl group containing from 1 to 24 carbon atoms, an aromatic group, chlorine, and bromine, $R_6$ and $R_7$ are independently selected from the group consisting of hydrogen, an alkyl or aromatic group, chlorine and bromine.

The acid catalyzed condensation reaction between a carbonyl compound and a triarylamine charge transport compound is performed under an inert gas such as nitrogen in a mixture of an organic solvent and an acid at between about 50° C. and about 300° C. or preferably at between about 100° C. and about 200° C. for between about 1 hour and about 1 week to give the polytriarylamine charge transport molecules of the present invention. Any suitable organic solvent can be used. Typical organic solvents include, for example, benzene, toluene, xylene, chlorobenzene, o-dichlorobenzene, anisole, chloroform, 1,1,2-trichloroethane, tetrahydrofuran, N,N-dimethyl formamide, dimethyl sulfoxide and the like. The role of the organic solvent is to ensure solubilization of the starting materials and products. The acid is typically a mixture of acetic acid and sulfuric acid.

Typical preferred organic polyarylamine charge transporting material of the third or fourth categories are illustrated in the formulae below:

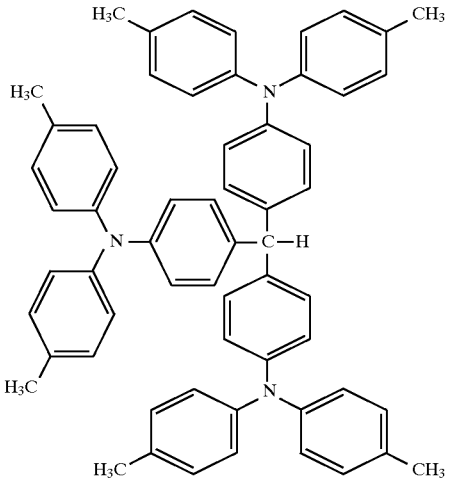

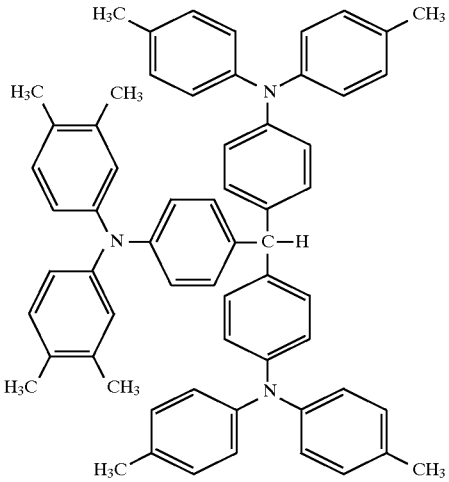

-continued
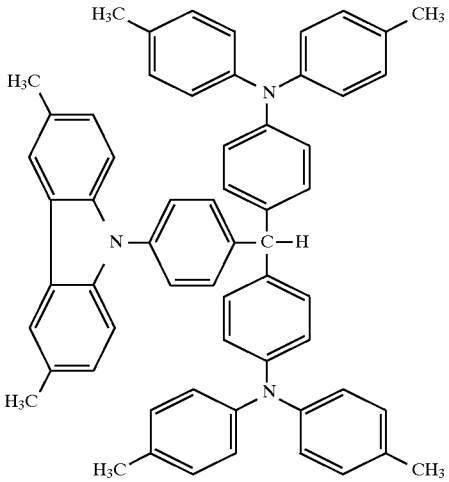
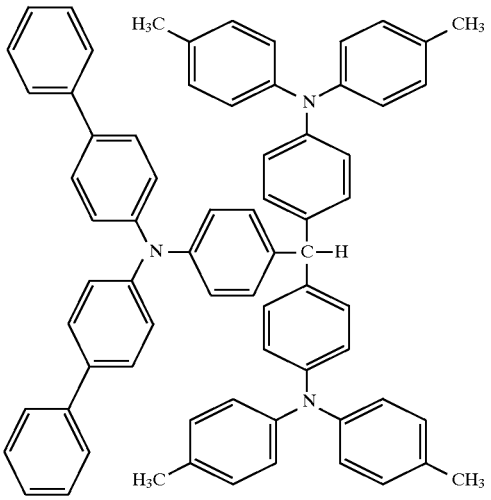
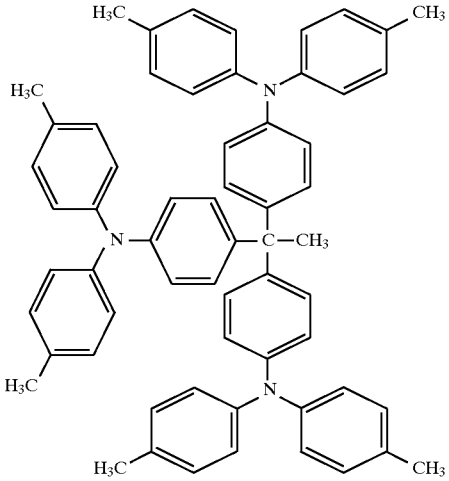
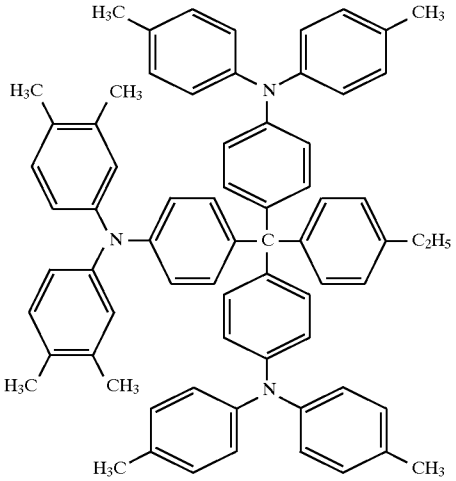
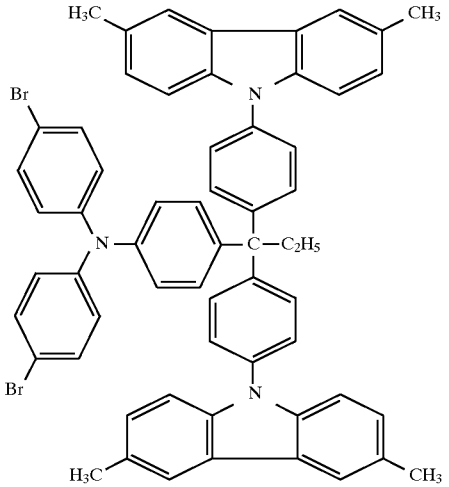
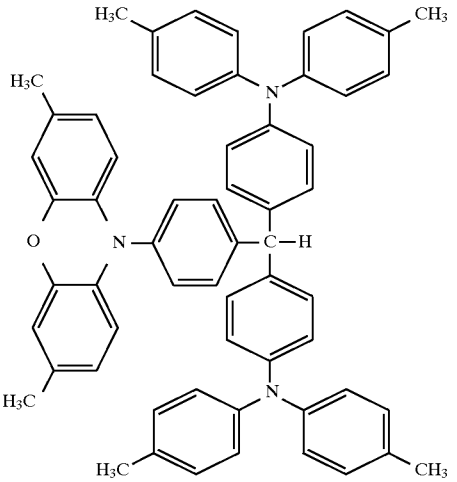

-continued
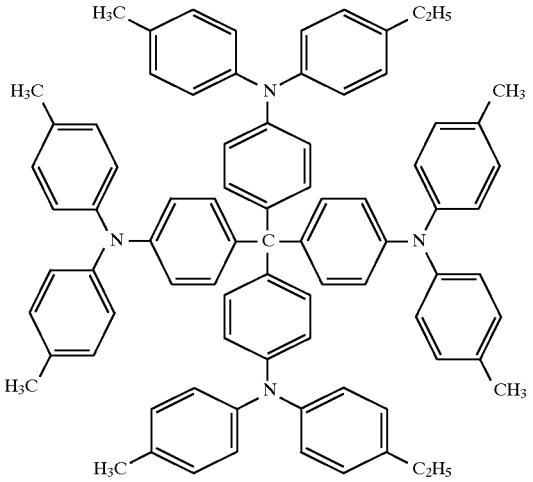
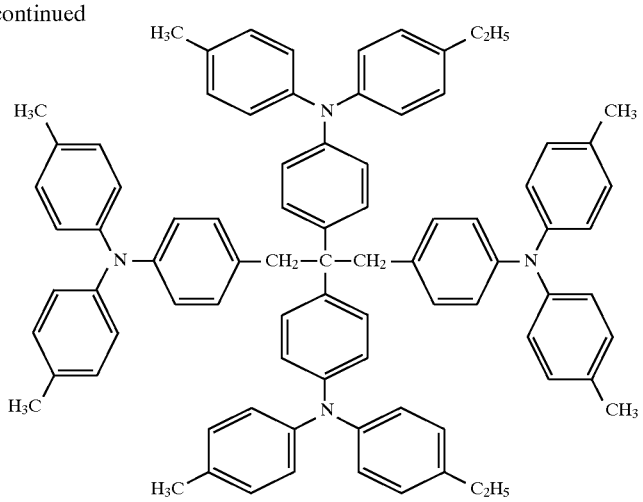
Typical preferred organic polyarylamine charge transporting material of the fifth category represented by the above formula A-[C($T_1$)$_2$-R]$_N$ are illustrated in the formulae below:
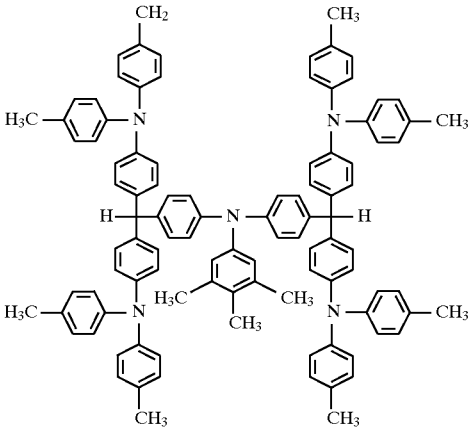
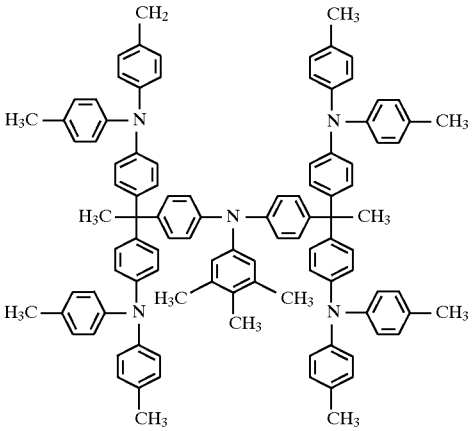

-continued
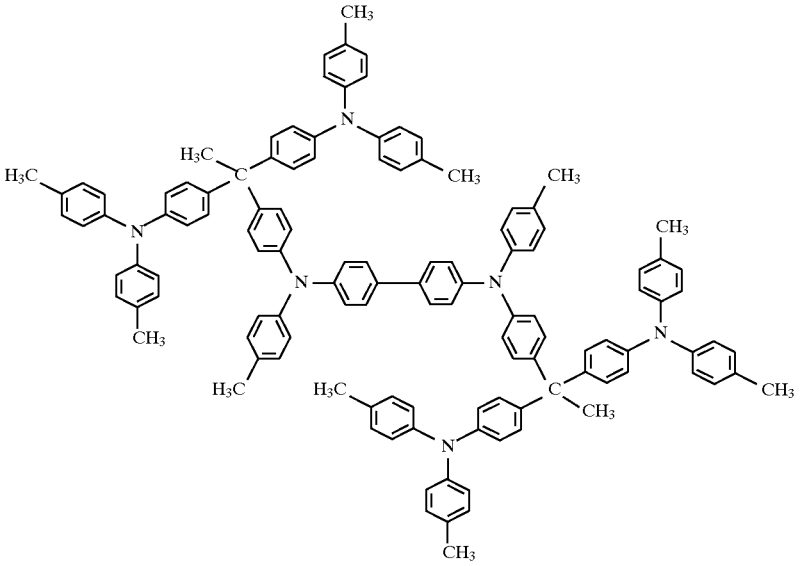
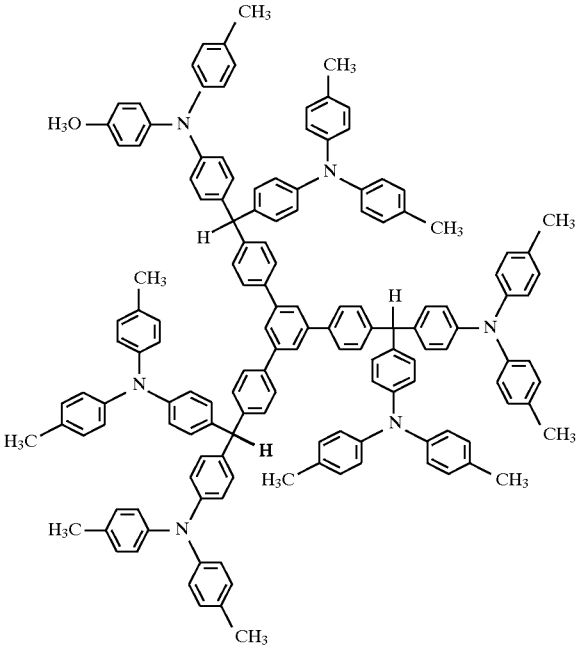

-continued
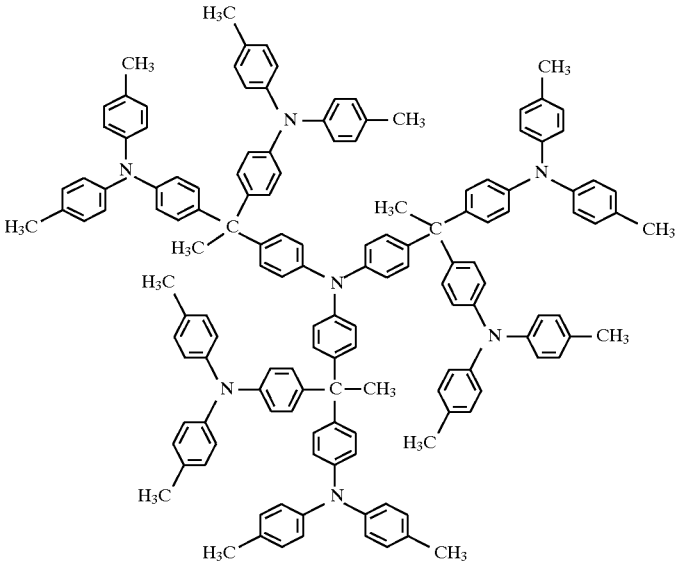
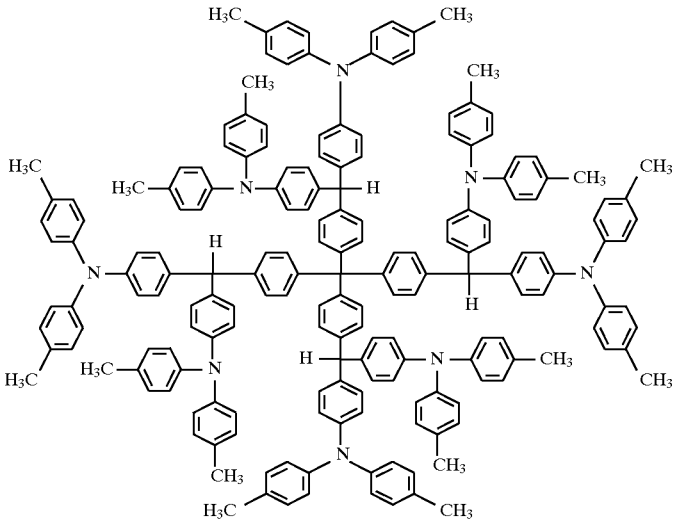

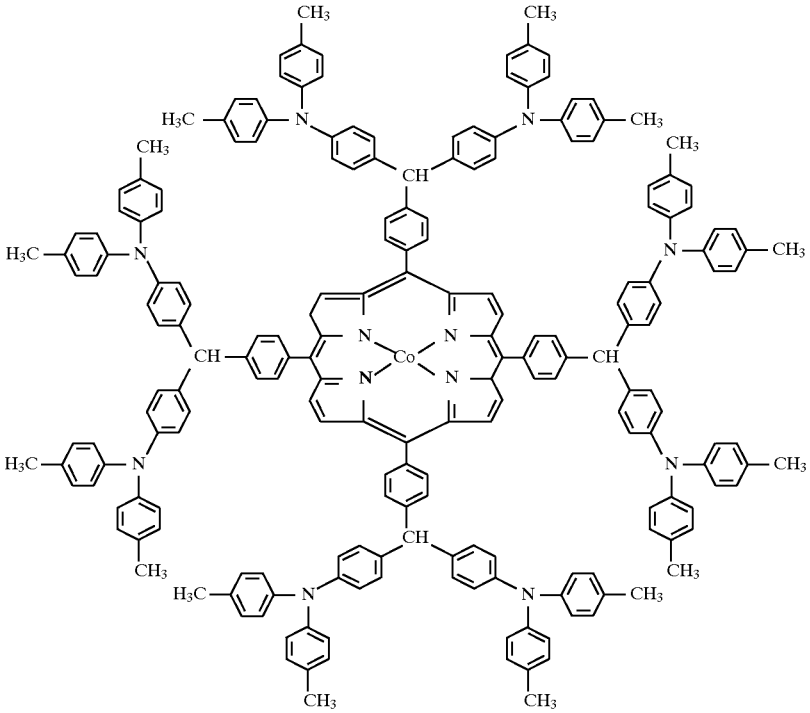
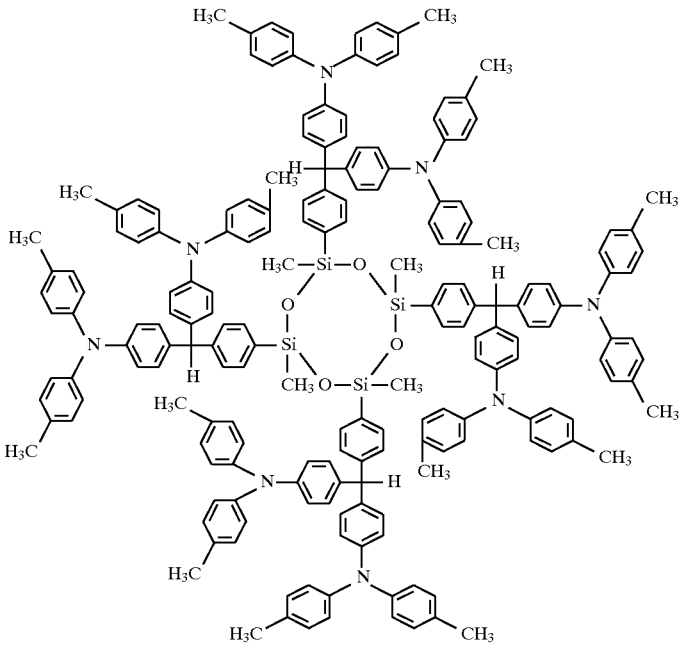

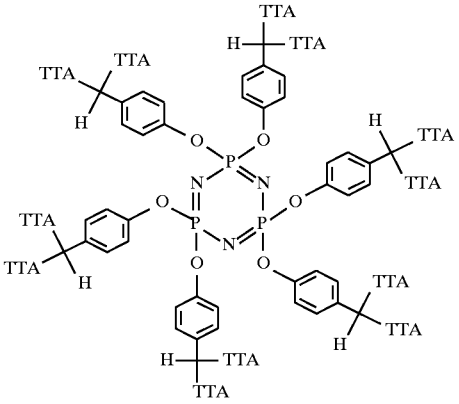
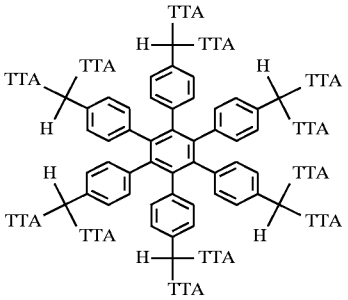
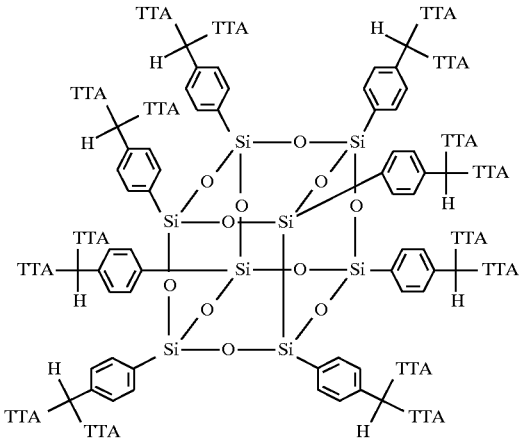
Wherein TTA is:
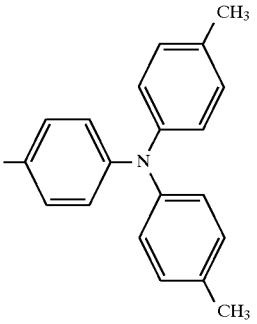
The sixth category of the present invention has the general structure:
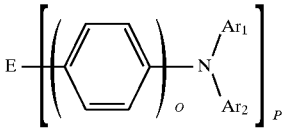
Wherein $Ar_1$ and $Ar_2$ are substituted and unsubstituted aromatic groups, L is 1, 2 or 3,M is an integral from 4 to 8 and E is a connecting group selecting from the following:

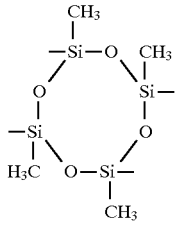
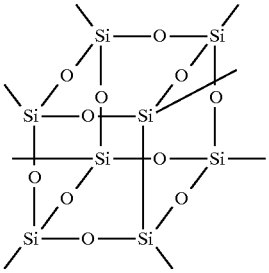
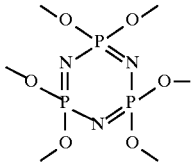
-continued
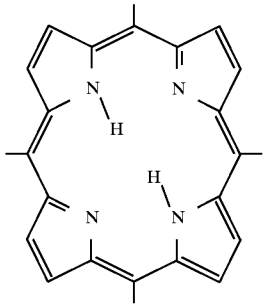
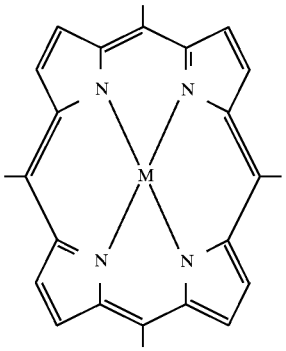
Wherein M is a divalent metal ion, such as Co(II), Fe(II), Mn(II) and the like. The preferred charge transport compounds of this category include:
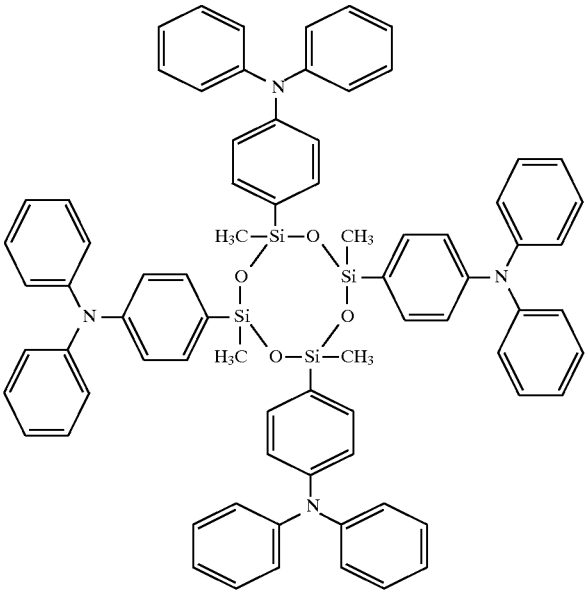

-continued
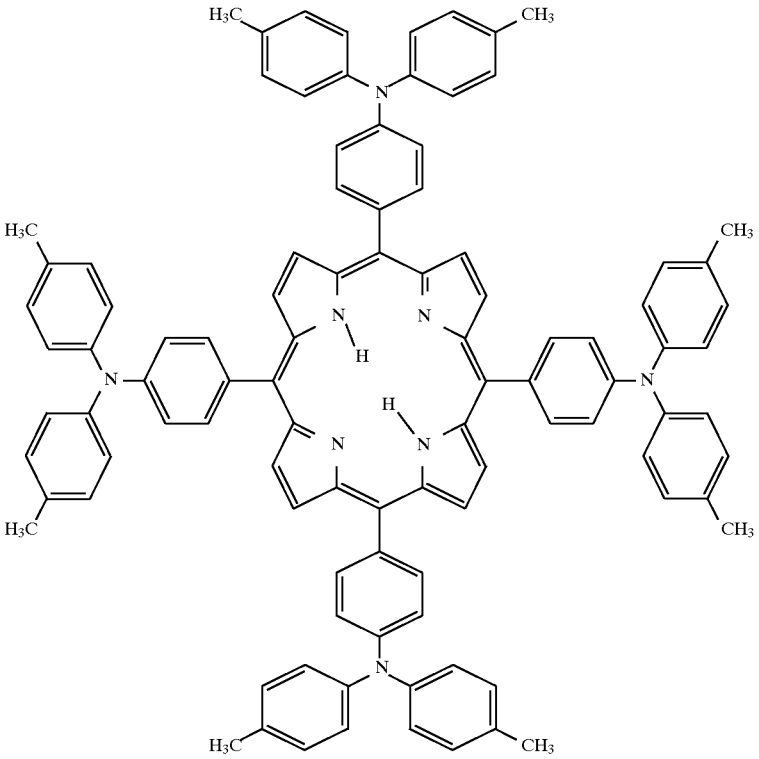
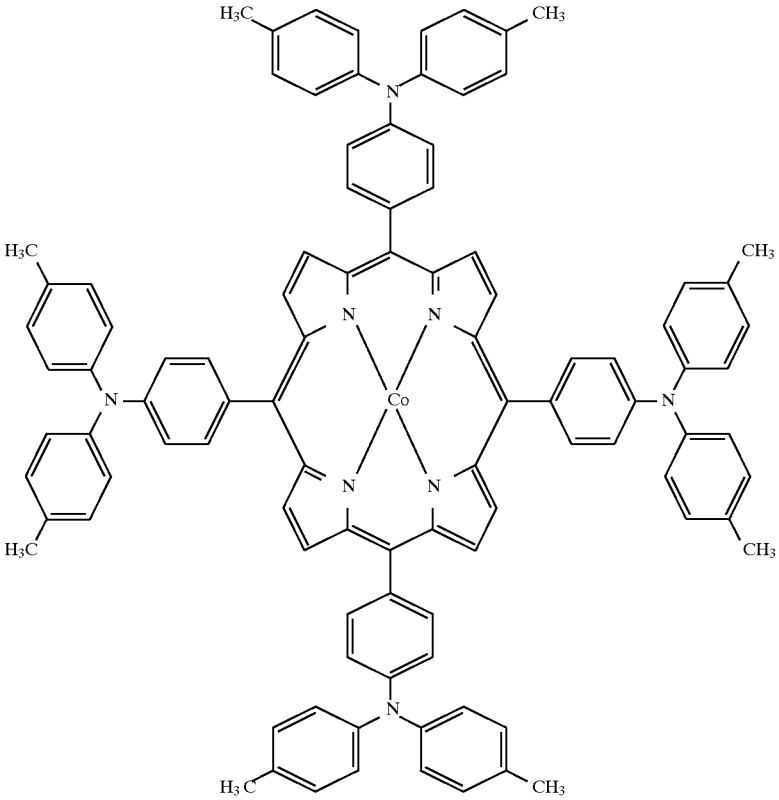

-continued

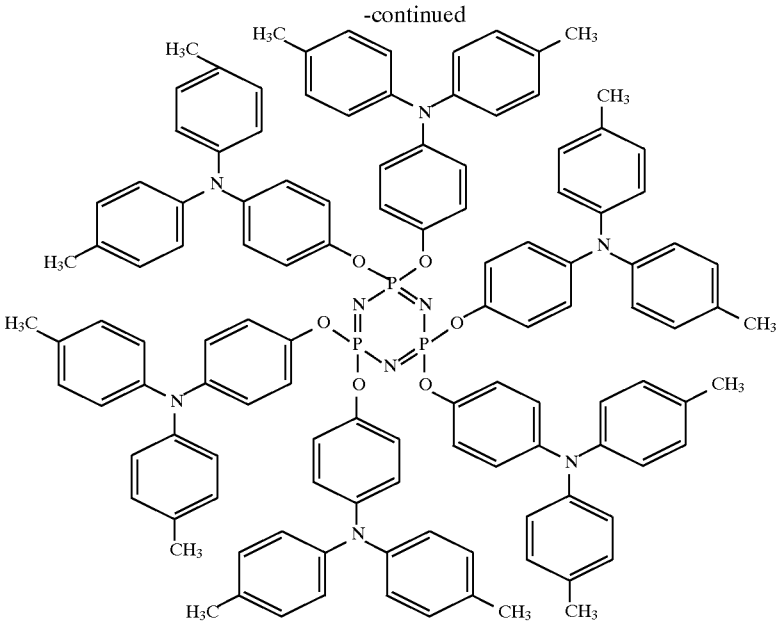

Wherein TTA is

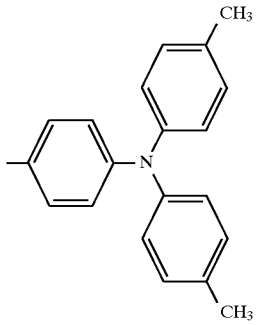

When the polyarylamine charge transporting molecules of this invention are employed in the charge transport layer of this invention with a film forming binder, they should be dissolved or be molecularly dispersed in the film forming binder. Any suitable inactive resin binder soluble in methylene chloride or other suitable solvent may be employed in the charge transport layer of this invention. Typical inactive resin binders include, for example, polycarbonate resin, polyvinylcarbazole, polyester, polyarylate, polyacrylate, polyether, polysulfone, and the like. Typical weight average molecular weights for the film forming binder can vary from between about 20,000 and about 1,500,000.

The preferred electrically inactive resin materials are polycarbonate resins have a molecular weight from about 20,000 to about 120,000, and more preferably from about 50,000 to about 100,000. The materials most preferred as the electrically inactive resin material is poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 100,000, available as Makrolon from Farbenfabricken Bayer A. G. and a polycarbonate resin having a molecular weight of from about 20,000 to about 50,000 available as Merlon from Mobay Chemical Company. Poly (4,4'-cyclohexylidenediphenylene carbonate) is also a preferred inert polymer binder. Methylene chloride solvent is a desirable component of the charge transport layer coating mixture for adequate dissolving of all the components and for its low boiling point. However, if desired, any other suitable solvent may be utilized.

The concentration of the combined mixture of the organic polyarylamine charge transporting small molecules of this and inert polymer in the charge transport layer relative to any other components in the layer should preferably be at least about 90 per cent because any anti oxidants or plasticizers that may be present in a concentration higher than about 10 percent by weight would not contribute to charge transport and would lower the charge carrier mobilities when present in concentrations greater than about 10 percent.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the hole transport layer is between about 5 to about 100 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1. In other words, the charge transport layer, is substantially non-absorbing to visible light or activating radiation in the region of intended use but is "active" in that it allows the injection of photogenerated holes from the photoconductive layer, i.e., charge generation layer, and allows these holes to be transported through the active charge transport layer to selectively discharge a surface charge on the surface of the active layer.

The photoreceptors of this invention may comprise, for example, a charge generator layer sandwiched between a conductive surface and a charge transport layer as described above or a charge transport layer sandwiched between a conductive surface and a charge generator layer. This structure may be imaged in the conventional xerographic manner which usually includes charging, optical exposure and development.

Other layers may also be used such as conventional electrically conductive ground strip along one edge of the belt or drum in contact with the conductive layer, blocking layer, adhesive layer or charge generating layer to facilitate connection of the electrically conductive layer of the photoreceptor to ground or to an electrical bias. Ground strips are well known and usually comprise conductive particles dispersed in a film forming binder.

Optionally, an overcoat layer may also be utilized to improve resistance to abrasion. In some cases an anti-curl back coating may be applied to the side opposite the photoreceptor to provide flatness and/or abrasion resistance. These overcoating and anti-curl back coating layers are well known in the art and may comprise thermoplastic organic polymers or inorganic polymers that are electrically insulating or slightly semi-conductive. Overcoatings are continuous and generally have a thickness of less than about 10 micrometers.

The transport layers of this invention exhibit numerous advantages; including high charge mobility, low dark decay, low residual voltages, low oxidation tendency, high glass transition temperatures. The transport layers of this invention also overcome the tendency of charge transporting small molecules to crystallize at high concentrations. A number of examples are set forth herein below and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

Synthesis of Tris[(di-p-tolylamino) methane]

Into a 250 milliliter 3-necked round bottom flask equipped with a mechanical stirrer, reflux condenser connected to an nitrogen inlet, an addition funnel was added N-phenyl-di-tolylamine (27.3 g, 0.10 mol), N, N-dimethylformamide (15.3 g, 18.0 ml, 0.42 mol) and methylene chloride (170 ml). Phosphorous oxychloride (13.5 ml, 22.2 g, 0.14 mol) was added into the addition funnel and then added slowly over 1 hour. The resulting solution was refluxed for 1 hour to give a dark solution. To this was added methylene chloride (150 ml) and the resulting solution was poured into ice water (600 ml). The organic phase was separated with a separatory funnel, extracted with 5% sodium carbonate (150 ml) and then s water (150ml), dried over magnesium sulfate to give a dark green solution. This was concentrated to give a brown crude product (31 g) which was the expected N,N-di-p-tolyl-N-4-formylphenyl amine according to its NMR spectrum: 9.76 (S, 1H), 7.62 (d, 2H), 7.17–7.12 (m, 8H), 6.96 (d, 2H), 2,34 (s, 6H). Recrystallization from methylene chloride (20 ml) and hexanes (30 ml) with slow evaporation gave yellow crystals (mp: 106.7–108.8° C., 24 g, 79%) in two crops. These were used to prepare the title compound as follow. Into a 250 ml round bottom flask equipped with mechanical stirrer, condenser connected to a nitrogen inlet, was added N,N-di-p-tolyl-N-4-formylphenyl amine (6.2 g, 0.02 mol), N-phenyl-N,N-di-4-tolylamine (10.9 g, 0.04 mol), acetic acid (50 ml) and methanesulfonic acid (0.16 ml) was added under nitrogen. The mixture was heated at 100° C. for 13 hours and then cooled. Benzene (200 ml) was added. The precipitate was collected and air dried to give a green powder which was dissolved in methylene chloride and pass through a neutral aluminum column with methylene chloride to give a white solid (11.0 g, 64%) which is the expected tris[(di-p-tolylamino) methane] according to its NMR spectrum: 7.04–6.91 (m, 36H), 5.31 (s, 1H), 2.29 (s, 18H).

EXAMPLE II

Synthesis of N,N'-di-{p-[1",1"-bis(N",N"-di-p-tolylaminophenyl)methyl]phenyl}-N,N'-di-p-tolyl-(1,1'-biphenyl)-4,4'-diamine Into a 1 L 3-necked round bottom flask equipped with a mechanical stirrer, reflux condenser connected to an nitrogen inlet, an addition funnel was added N,N'-diphenyl-N, N'-di(p-tolyl)-1,1'-biphenyl-4,4'-diamine (51.7 g, 0.1 mol), N, N-dimethylformamide (33.0 ml, 0.43 mol) and methylene chloride (250 ml). Phosphorous oxychloride (28.0 ml, 0.30 mol) was added into the addition funnel and then added dropwise over 30 min. The resulting dark brown solution was refluxed for 22 hours to give a dark solution and then cooled. To this was added methylene chloride (850 ml) and the resulting solution was poured into ice water (850 ml). The organic phase was separated with a separatory funnel, extracted with 5% sodium carbonate (200 ml) and then water (200 ml), dried over magnesium sulfate to give a dark green solution. This was concentrated to give a yellow-brown solid (mp: 67°–70° C.; 75 g) which was the expected N,N'-di-p-formylphenyl-N,N'-di(p-tolyl)-1,1'-biphenyl-4,4'-diamine according to its NMR spectrum: 9.80 (S, 2H), 7.75 (d, 4H), 7.51 (d, 4H), 7.25–7.0 (m, 16H), 2,36 (s, 6H). The following is a prophetic procedure for the preparation of the above titled compound using the crude N,N'-di-p-formylphenyl-N,N'-di(p-tolyl)-1,1'-biphenyl-4,4'-diamine. Into a 250 ml round bottom flask equipped with mechanical stirrer, condenser connected to a nitrogen inlet, is added N,N'-di-p-formylphenyl-N,N'-di(p-tolyl)-1,1'-biphenyl-4,4'-diamine (5.2 g, 0.01 mol), N-phenyl-N,N-di-4-tolylamine (10.9 g, 0.04 mol), acetic acid (50 ml) and methanesulfonic acid (0.16 ml) was added under nitrogen. The mixture is heated at 100° C. for 13 hours and then cooled. Benzene (200 ml) was added. The precipitate is collected and air-dried to give a green powder. This is dissolved in methylene chloride and pass through a neutral aluminum column with methylene chloride to give the title compound.

EXAMPLE III

Synthesis of 1,2-[bis-p-tolylaminophenyl]-3,4,5,6-tetraphenylbenzene

Into a 1 L flask equipped with an addition funnel, di-p-tolylphenylamine (137 g, 0.5 mol) in chloroform (300 ml) was added a solution of bromine (80 g) in chloroform (300 ml) dropwise for an hour. The resulting green solution was stirred for 2 h and then concentrated to give a green solid (175 g). This was dissolved in hot ethanol (1200 ml) in a 2 L flask and with activated charcoal for 30 min under nitrogen. The solution was filtered while hot to give a light green solution. The pale green crystals formed upon cooling were collected as the first crop (70 g). Additional crystals (70 g) were obtained in three more crops. The crystals were identified from a NMR spectrum as di-p-tolyl-p-bromophenylamine. This compound (21.8 g, 0.062 mol), bis(tributylstannyl) acetylene (20.0 g, 0.033 mol), tetrakis (triphenylphosphine) palladium (1.60 g), and dry tetrahydrofuran (180 ml) were added into a 500 ml round bottom flask equipped with magnetic stirrer, condenser connected to a nitrogen inlet. The reaction mixture was refluxed for 24 h under nitrogen and then cooled and concentrated to give a red oil. To this was added 1.0M sodium hydroxide solution (400 ml) and then sonicated for 20 min. The tacky solid formed was collected and dried overnight in air and then added into ethyl acetate (20 ml) stirred for 30 min to form a powdery solid. This was collected, air dried and identified as bis[4-(p-tolylaminophenyl)] acetylene. This (2.84 g, 0.005 mol) and tetraphenylcyclopentadienone (1.92 g, 0.005 mol) was placed in a 100 ml round bottom flask equipped with a magnetic stirrer and a nitrogen inlet. The mixture was heated at 200° C. for 2 h with a sand bath. Upon cooling to about 150° C., ethanol (30 ml) was added. The resulting mixture was stirred until a fine suspension was obtained. The powder was collected by suction filtration and air-dried to give a light gray solid (3.0 g). This was further purified by flash chromatography with neutral alumina to give the titled compound as a white powder.

EXAMPLE IV

A photoreceptor was prepared by forming coatings using conventional techniques on a substrate comprising a vacuum deposited titanium layer on a polyethylene terephthalate film (Melinex®, available from E. I. duPont de Nemours & Co.). The first deposited coating was a siloxane barrier layer formed from hydrolyzed gamma aminopropyltriethoxysilane having a thickness of 100 angstroms. The second coating was an adhesive layer of polyester resin (49,000, available from E. I. duPont de Nemours & Co.) having a thickness of 50 angstroms. The next coating was a charge generator layer containing 35 percent by weight of a perylenebismidazoles particles dispersed in a polyester resin (Vitel® PE100, available from Goodyear Tire and Rubber Co.) having a thickness of 1 micrometer. The last coating was a charge transport layer consisting of a 20 micron thick layer of bisphenol A polyethercarbonate mixed with 40 percent by weight of tris[(di-p-tolylamino) methane], the compound described in Example I. Sensitivity measurements were performed in a scanner. The photoreceptor device was mounted on a cylindrical aluminum drum which was rotated on a shaft. The film was charged by a corotron mounted along the perimeter of the drum. The surface potential of the photoreceptor was measured as a function of time by several capacitively coupled probes placed at different locations around the perimeter of the drum. The probes were calibrated by applying known potentials to the drum substrate. The photoreceptor film on the drum was exposed and erased by light sources located at appropriate positions around the periphery of the drum. The measurement involved charging the photoconductor device in a constant current or voltage mode. As the drum rotated, the initial charging potential was measured by probe 1. Further rotation lead to the exposure station, where the photoconductor device was exposed to monochromatic radiation of a known intensity. The surface potential after exposure was measured by probes 2 and 3. The device was finally exposed to an erase lamp of appropriate intensity and any residual potential was measured by probe 4. The process was repeated with the magnitude of the exposure automatically changed during the next cycle. A photo induced discharge characteristics (PIDC) curve was obtained by plotting the potentials at probes 2 and 3 as a function of exposure. The device was charged to a negative polarity by corotron charging and discharged by monochromatic light in the visible portion of the light spectrum. The device initially charged to 800 volts could be discharged to less than 150 Volts when exposed to 670 nm wavelength light with a light energy of 20 ergs/cm$^2$. The device also showed low dark decay and acceptable cyclic stability up to 10 K cycles.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrophotographic imaging member comprising a supporting substrate and at least one photoconductive layer, said photoconductive layer comprising a charge transporting material selected from the group consisting of six categories of organic aromatic polyarylamine materials, the first of said categories being selected from the group consisting of compounds represented by the following formulae:

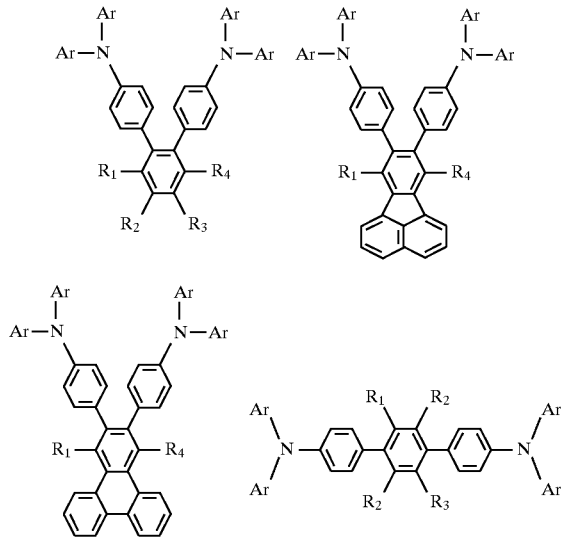

-continued

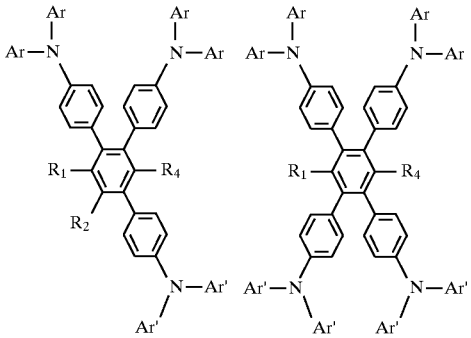

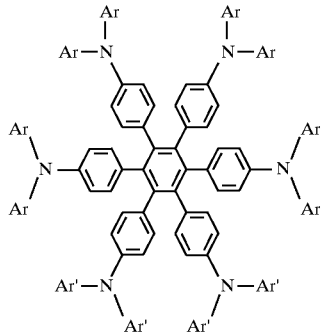

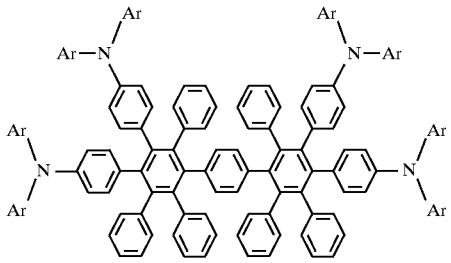

wherein:

$R_1$, $R_2$, $R_3$, $R_4$ are independently selected from the group consisting of substituted or unsubstituted alkyl groups containing from 1 to 24 carbon atoms and substituted or unsubstituted aromatic groups, if at least one of $R_1$, $R_2$, $R_3$, $R_4$ is:

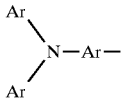

then at least one other of $R_1$, $R_2$, $R_3$, $R_4$ is:

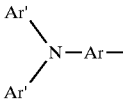

Ar and Ar' are substituted or unsubstituted aromatic groups and Ar is different from Ar';

the second of said categories being selected from compounds having two polymerizable functional groups represented by the following formulae as well as their polymeric reaction products:

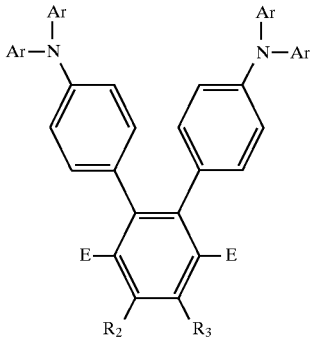

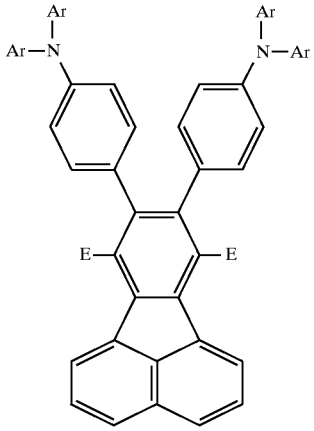

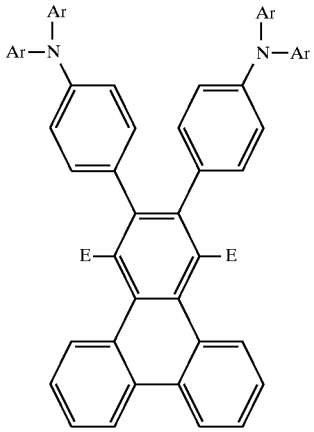

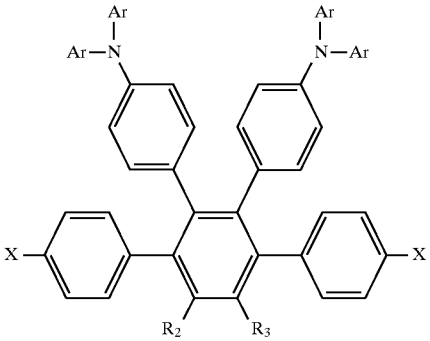

-continued

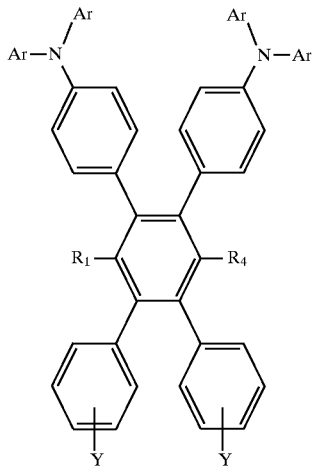

wherein:

$R_2$ and $R_3$ are independently selected from the group consisting of substituted or unsubstituted alkyl groups containing from 1 to 24 carbon atoms and substituted or unsubstituted aromatic groups, E is selected from the group consisting of methyl ester, ethyl ester and acetyl groups and X and Y are selected from the group consisting of OH, Cl, Br and I;

the third, fourth and fifth of said categories being selected from the group consisting compounds represented by the following formulae:

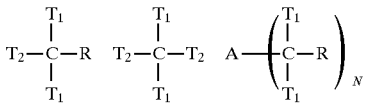

wherein:

$T_1$ and $T_2$ are selected from the group consisting of

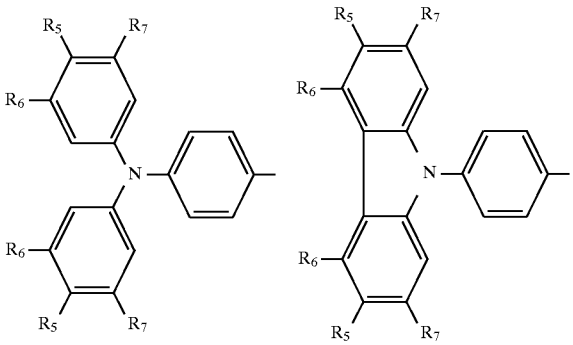

-continued

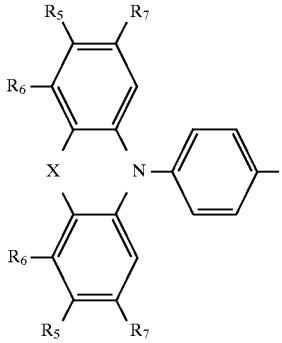

and $T_2$ can alternatively be selected from the group consisting of

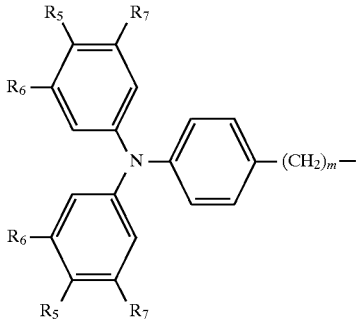

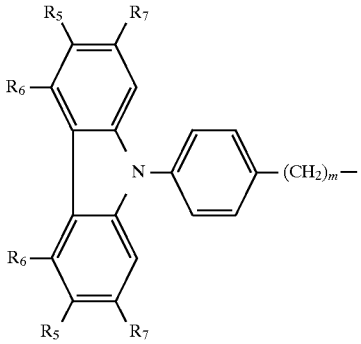

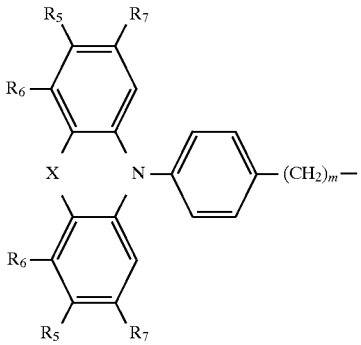

wherein

R is selected from the group consisting of hydrogen, substituted or unsubstituted alkyl groups containing from 1 to 12 carbon atoms, and substituted or unsubstituted aromatic groups, N is an integer from 2 to 6, A is a connecting aromatic group, $R_5$ is selected from the group consisting of substituted or unsubstituted alkyl groups containing from 1 to 24 carbon atoms and substituted or unsubstituted aromatic groups, $R_6$ and $R_7$ are independently selected from the group consisting of hydrogen, substituted or unsubstituted alkyl groups containing from 1 to 24 carbon atoms and substituted or unsubstituted aromatic groups, and m is an integer from 0 to 12; and the sixth of said categories being selected from compounds represented by the following formula:

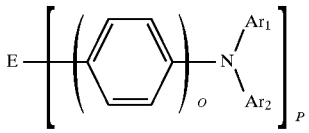

wherein $Ar_1$ and $Ar_2$ are substituted and unsubstituted aromatic groups,

O is 1,2or 3,

P is an integral from 4 to 8 and

E is a connecting group selecting from the group consisting of:

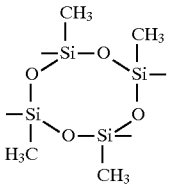

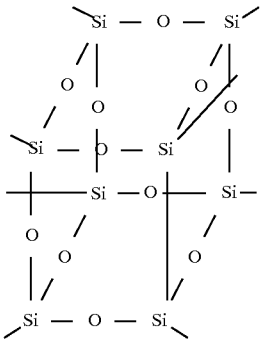

-continued

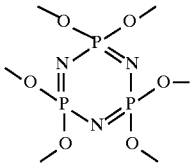

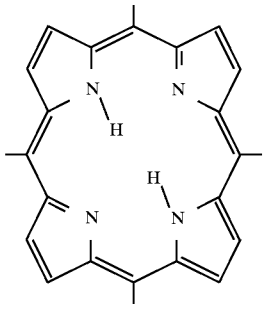

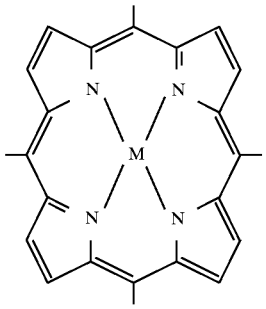

wherein M is a divalent metal ion.

2. An electrophotographic imaging member according to claim 1 wherein when N is 2, A is selected from the group consisting of

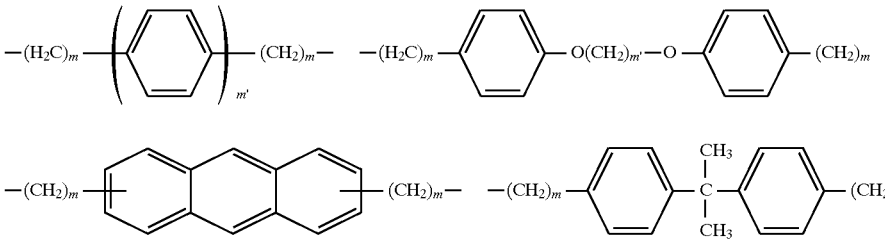

-continued
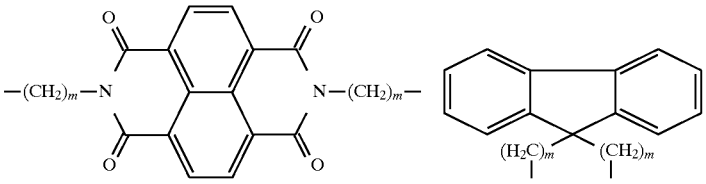
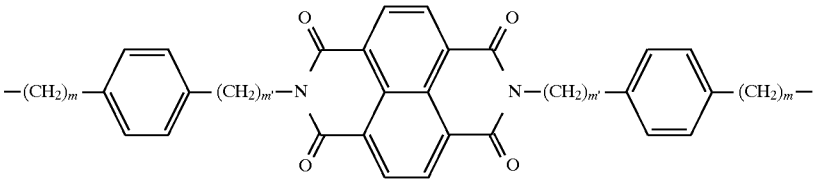
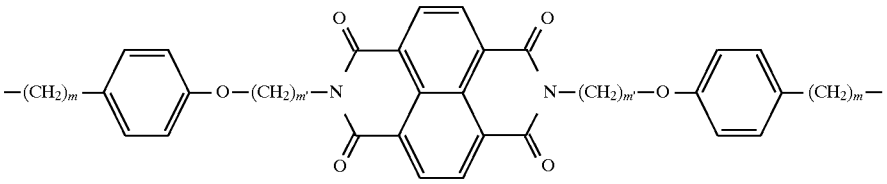
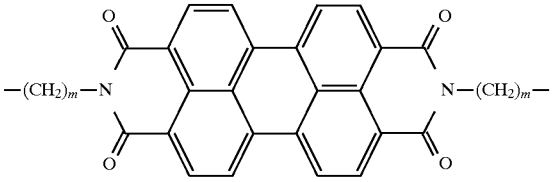
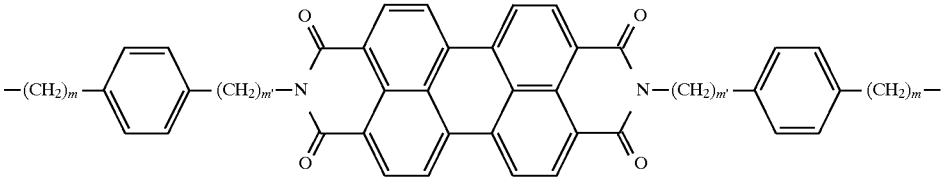
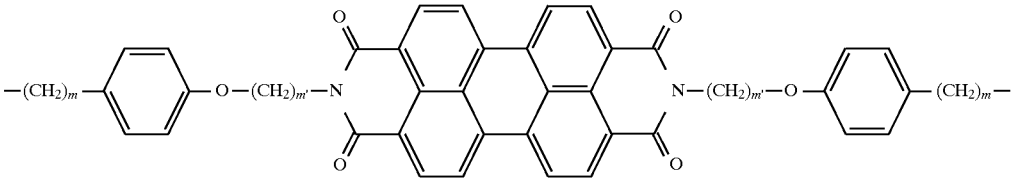
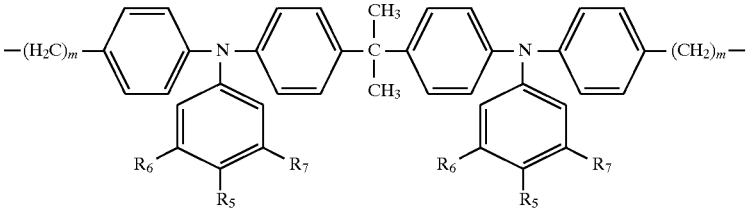
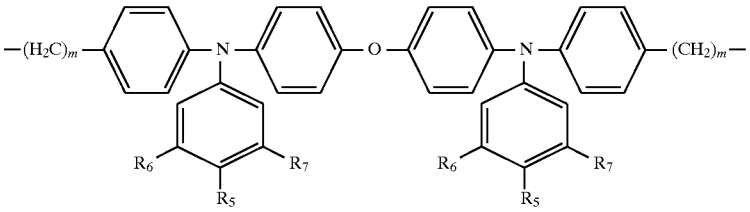

-continued
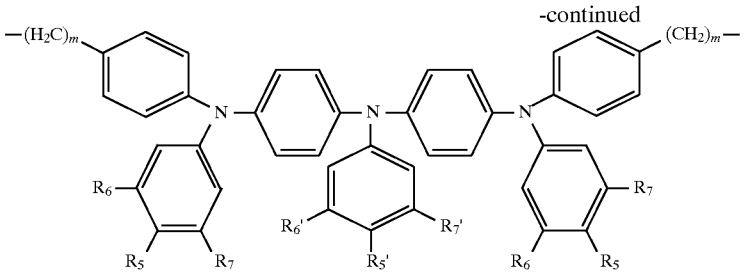
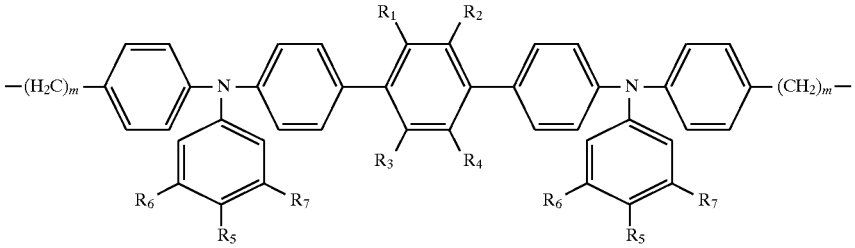
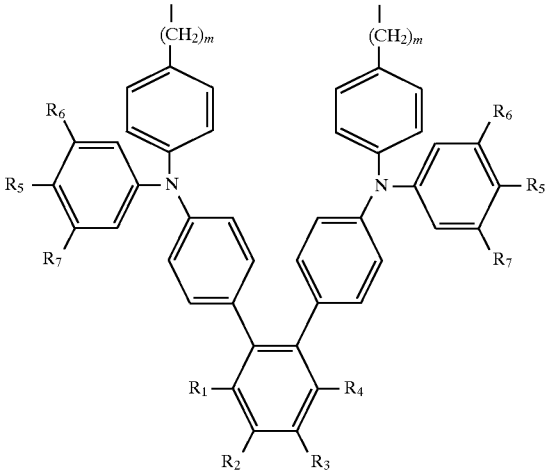
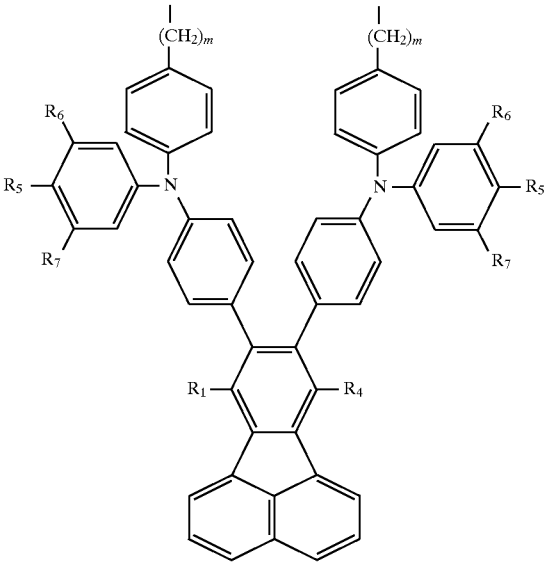
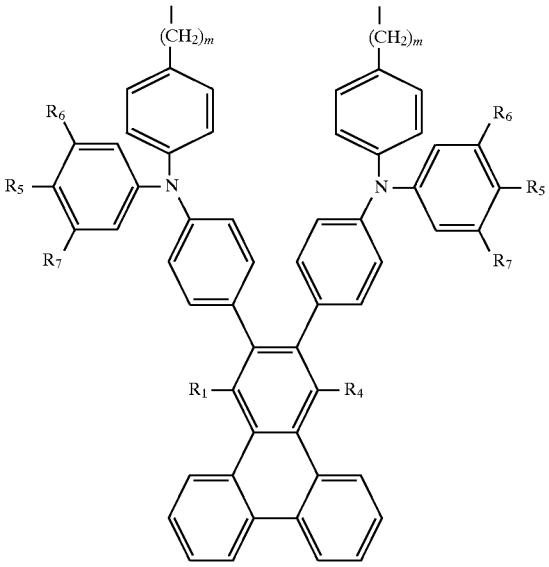

wherein
m and m' are integers from 1 to 12;
$R_5$ and $R_5'$ are alkyl groups containing 1 to 24 carbon atoms; and
R, $R_1$, $R_2$, $R_3$, $R_4$, $R_6$, $R_6$, $R_7$, $R_7$, $R_8$ are hydrogen, halogens, alkyl groups containing 1 to 24 carbon atoms or aromatic groups.
3. An electrophotographic imaging member according to claim 1
wherein
when N is 3, A is selected from the group consisting of
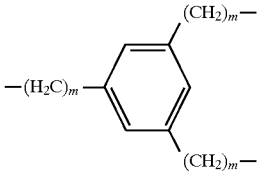
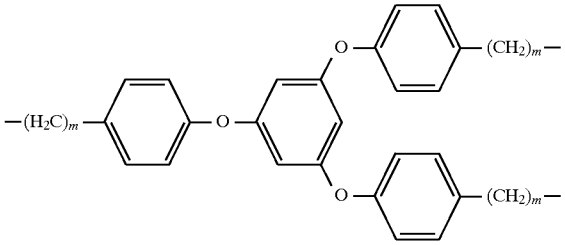
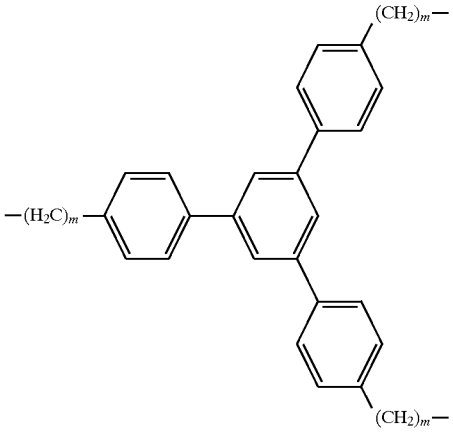
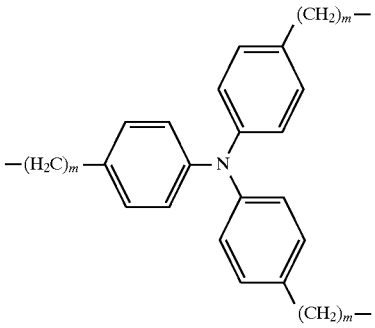
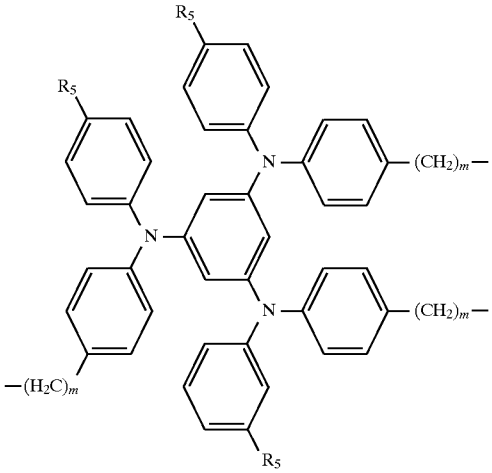
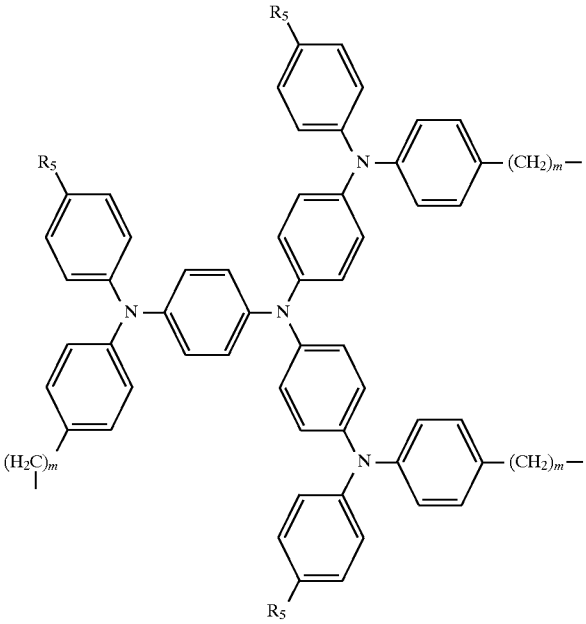

-continued
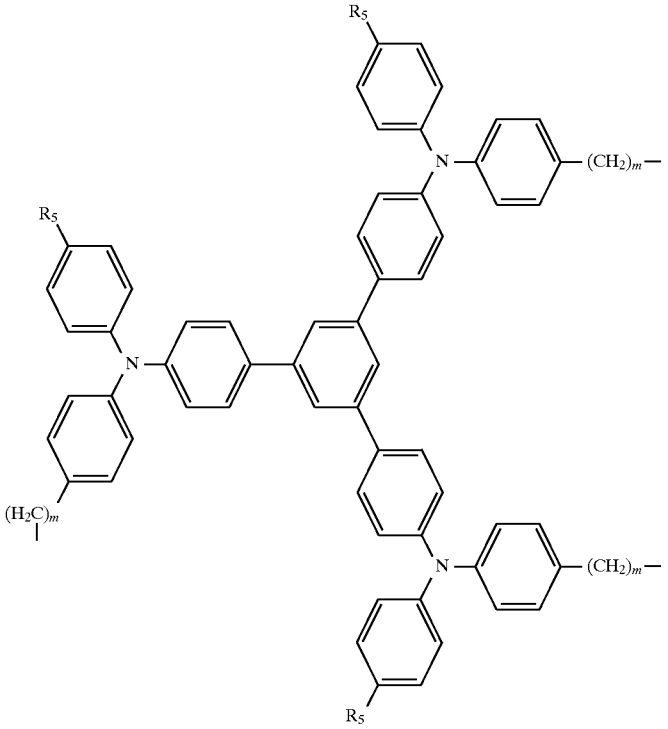
where in m is an integer from 0 to 12 and $R_5$ is alkyl group containing 1 to 24 carbon atoms.
4. An electrophotographic imaging member according to claim 1
wherein
when N is 4, A is selected from the group consisting of
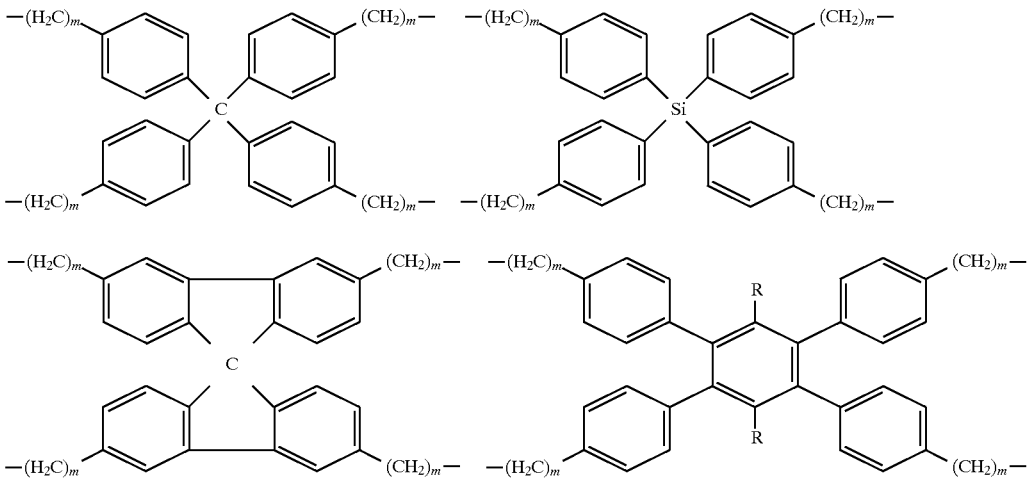

-continued

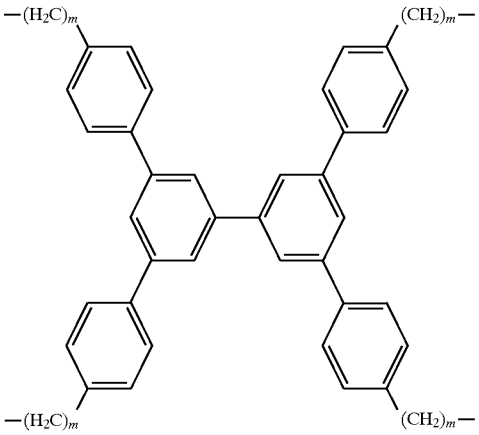

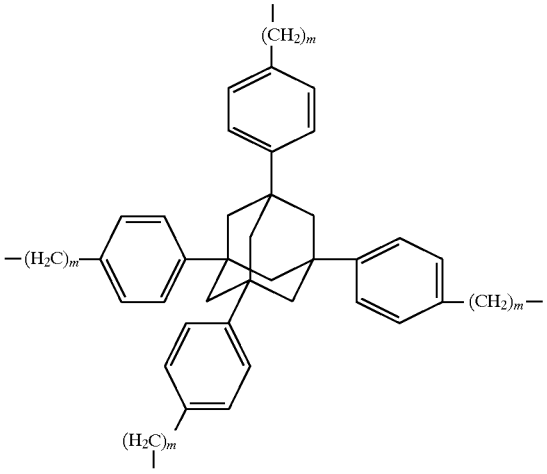

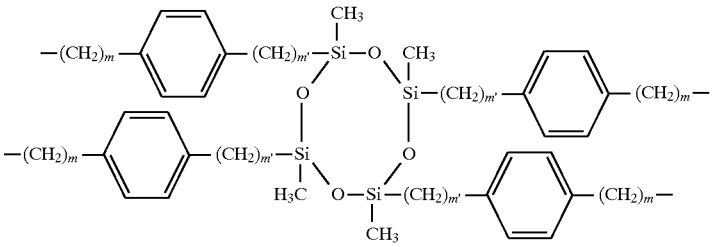

m and m' are integers from 0 to 12, $R_5$ is an alkyl group containing 1 to 24 carbon atoms; R is selected from the group consisting of hydrogen, halogen, alkyl group containing 1 to 24 carbon atoms and aromatic group and Ar is an aromatic group selected from the group consisting of

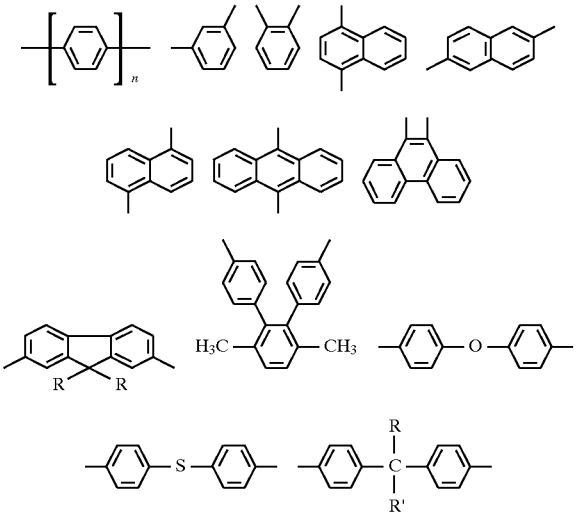

-continued

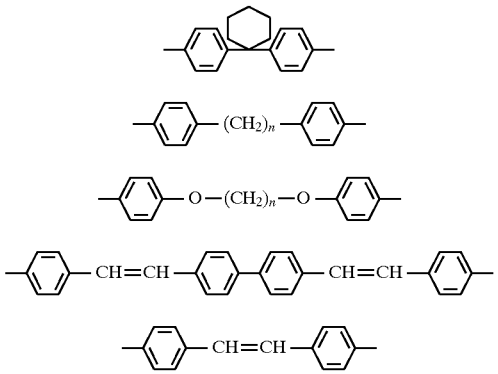

wherein n is an integer from 1 to 12 and R and R' are alkyl groups containing 1 to 12 carbon atoms.

5. An electrophotographic imaging member according to claim 1 wherein when N is 6, A is selected from the group consisting of

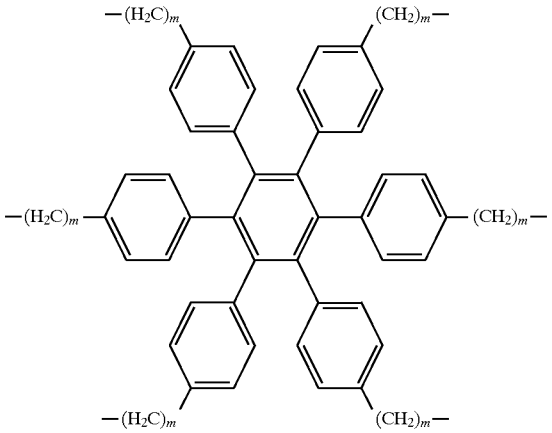
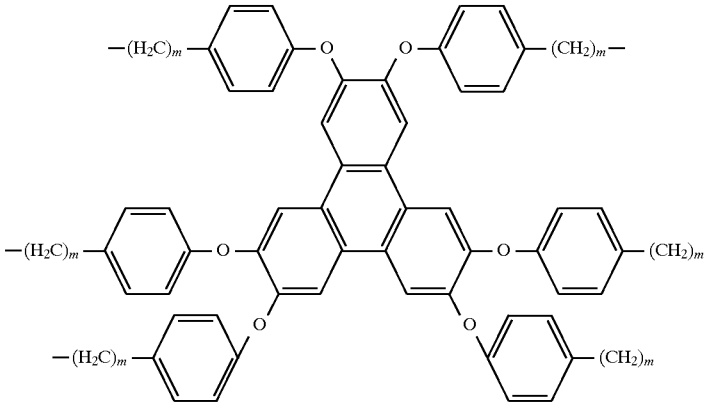
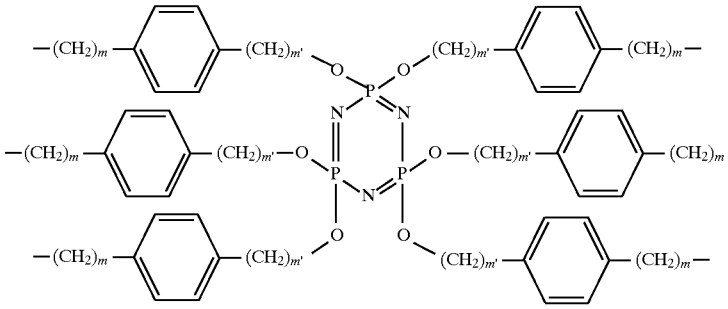
m and m' are integers from 0 to 12.
6. An electrophotographic imaging member according to claim 1
wherein
when N is 8, A is

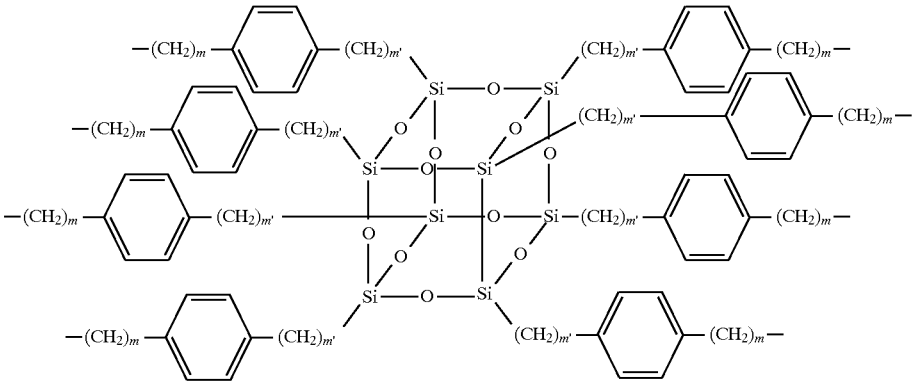

m and m' are integers from 0 to 12.

7. An electrophotographic imaging member according to claim 1 wherein the organic polyarylamine compound represented by the formulae in said third, fourth and fifth of said categories are derived from an acid catalyzed condensation reaction between a carbonyl compound and a triarylamine charge transport compound.

8. An electrophotographic imaging member according to claim 1 wherein the organic polyarylamine compound represented by the formulae in the sixth category is a reaction product selected from the group consisting of (1) a tetrabromo, tetrachloro, or tetraiodo compound with a least four equivalents of a diarylamine compound in the presence of a catalyst selected from the group consisting of copper, nickel and palladium; (2) a hexabromo, hexachloro, or hexaiodo compound with a least six equivalents of a diarylamine compound in the presence of a catalyst selected from the group consisting of copper, nickel and palladium;.and (3) a octabromo, octachloro, or octaiodo compound with a least eight equivalents of a diarylamine compound in the presence of a catalyst selected from the group consisting of copper, nickel and palladium.

9. An electrophotographic imaging member according to claim 1 wherein the organic polyarylamine compound represented by the formulae in said first category is a reaction product of a cyclopentadienone compound and dienophile containing compound, at least one of which contains two identical triarylamine groups.

10. An electrophotographic imaging member according to claim 1 wherein the organic polyarylamine compound represented by the formulae in the first category is a reaction product of a dibromo or diiodo compound with a least two equivalents of a diarylamine compound in the presence of a catalyst selected from the group consisting of copper, nickel and palladium.

11. An electrophotographic imaging member according to claim 1 wherein said at least one photoconductive layer comprises a charge generating layer and a charge transport layer and the charge transport layer comprises the organic polyarylamine charge transporting material.

12. An electrophotographic imaging member according to claim 9 wherein said charge transport layer comprises between about 35 percent and about 45 percent by weight of at least one of the organic polyarylamine charge transporting material, and about 65 percent to about 55 percent by weight of a polymeric film forming resin.

13. An electrophotographic imaging member according to claim 1 wherein the organic polyarylamine compound represented by the formulae in the second category is a polyester formed from condensation polymerization of a bisphenol reactant and an organic polyarylamine reactant containing two polymerizable functional groups selected from the group consisting of dicarboxylic acid and dicarboxylic acid dialkylester.

14. An electrophotographic imaging member according to claim 1 wherein the organic polyarylamine compound represented by the formulae in the second category is a polyamide formed from condensation polymerization of a diamine monomer reactant and an organic polyarylamine reactant containing two polymerizable functional groups selected from the group consisting of dicarboxylic acid and dicarboxylic acid dialkylester.

15. An electrophotographic imaging member according to claim 1 wherein the organic polyarylamine compound represented by the formulae in the second category is a polycarbonate formed from polymerization of a phosgene reactant and an organic polyarylamine reactant containing two polymerizable functional hydroxy groups.

16. An electrophotographic imaging member according to claim 1 wherein the organic polyarylamine compound represented by the formulae in the second category is a polyester formed from polymerization of an organic polyarylamine reactant containing two polymerizable functional hydroxy groups and a reactant containing two polymerizable functional groups selected from the group consisting of diacid groups and diester groups.

17. An electrophotographic imaging member according to claim 1 wherein the organic polyarylamine compound represented by the formulae in the second category is an organic polyarylamine charge transporting polymer formed from metal catalyzed self-polymerization of an organic polyarylamine reactant containing two polymerizable functional halogen groups.

18. An electrophotographic imaging member according to claim 1 wherein the organic polyarylamine compound represented by the formulae in the second category is a conjugated organic polyarylamine charge transporting polymer formed from polymerization of a diboronic acid monomer and an organic polyarylamine reactant containing two polymerizable functional halogen groups.

19. An electrophotographic imaging process comprising providing an electrophotographic imaging member comprising a supporting substrate and at least one photoconductive layer, said photoconductive layer comprising a charge transporting material selected from the group consisting of five categories of organic aromatic polyarylamine materials, the first of said categories being selected from the group consisting compounds represented by the following formulae:

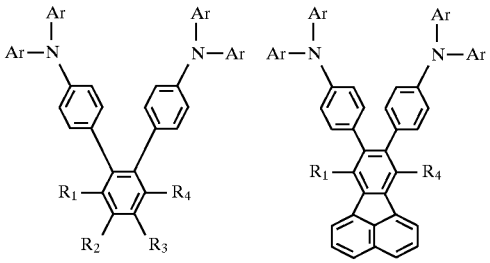

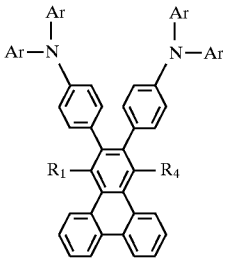

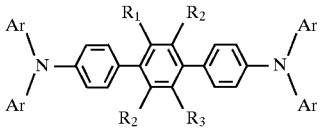

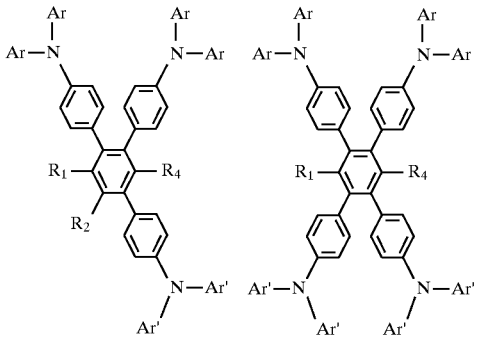

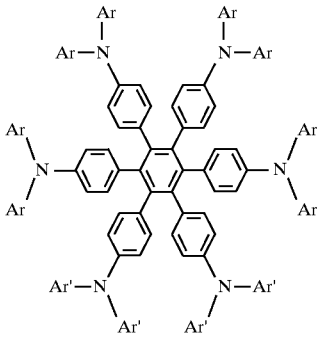

-continued

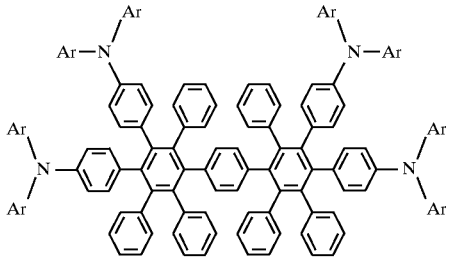

wherein:

$R_1$, $R_2$, $R_3$, $R_4$ are independently selected from the group consisting of substituted or unsubstituted alkyl groups containing from 1 to 24 carbon atoms and substituted or unsubstituted aromatic groups, if at least one of $R_1$, $R_2$, $R_3$, $R_4$ is:

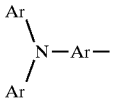

then at least one other of $R_1$, $R_2$, $R_3$, $R_4$ is:

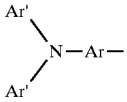

Ar and Ar' are substituted or unsubstituted aromatic groups and Ar is different from Ar';

the second of said categories being selected from compounds having two polymerizable functional groups represented by the following formulae as well as their polymeric reaction products:

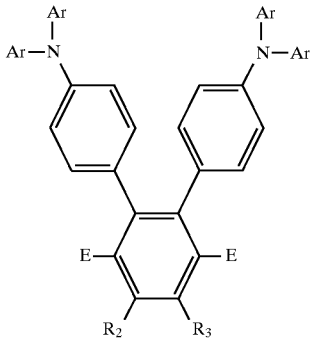

-continued

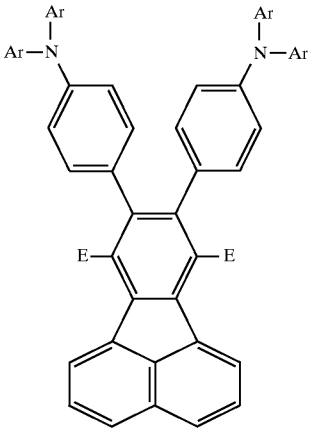

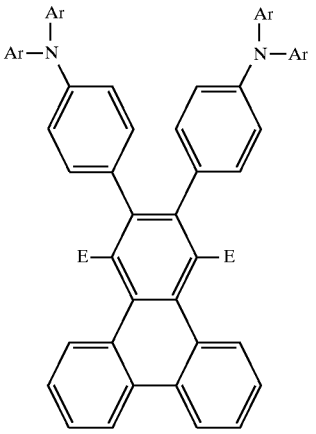

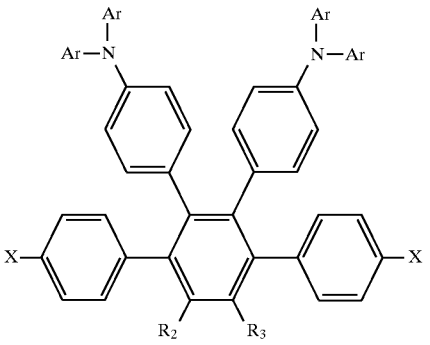

-continued

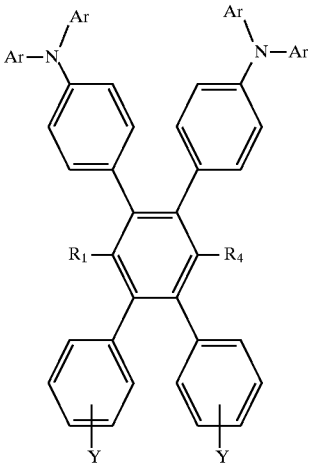

wherein:

$R_2$ and $R_3$ are independently selected from the group consisting of substituted or unsubstituted alkyl groups containing from 1 to 24 carbon atoms and substituted or unsubstituted aromatic groups, E is selected from the group consisting of methyl ester, ethyl ester and acetyl groups and X and Y are selected from the group consisting of OH, Cl, Br and I.

the third, fourth and fifth of said categories being selected from the group consisting compounds represented by the following formulae

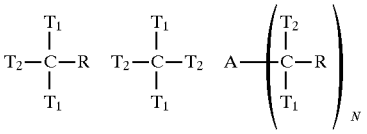

wherein:

$T_1$ and $T_2$ are selected from the group consisting of

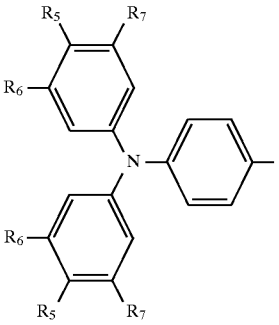

-continued

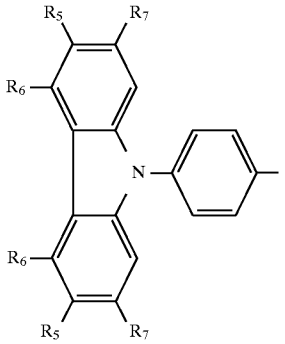

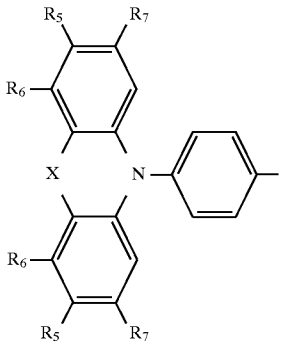

and $T_2$ can alternatively be selected from the group consisting of

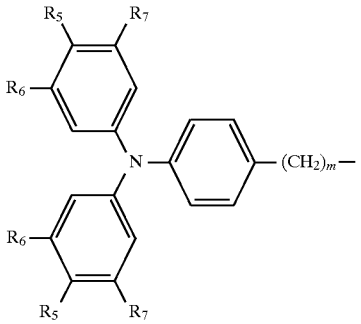

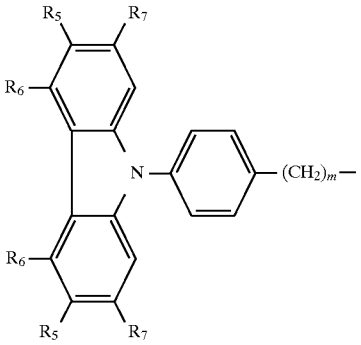

-continued

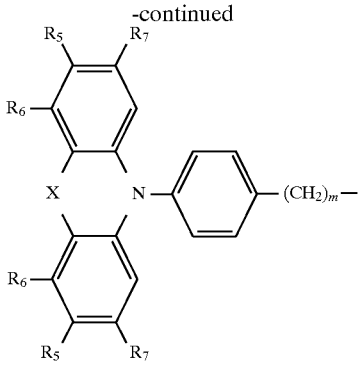

wherein

R is selected from the group consisting of hydrogen, substituted or unsubstituted alkyl groups containing from 1 to 12 carbon atoms, and substituted or unsubstituted aromatic groups, N is an integer from 2 to 6, A is a connecting aromatic group, $R_5$ is selected from the group consisting of substituted or unsubstituted alkyl groups containing from 1 to 24 carbon atoms and substituted or unsubstituted aromatic groups, $R_6$ and $R_7$ are independently selected from the group consisting of hydrogen, substituted or unsubstituted alkyl groups containing from 1 to 24 carbon atoms and substituted or unsubstituted aromatic groups, and m is an integer from 0 to 12; and the sixth of said categories being selected from compounds represented by the following formula:

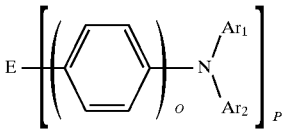

wherein $Ar_1$ and $Ar_2$ are substituted and unsubstituted aromatic groups,

O is 1, 2 or 3,

P is an integral from 4 to 8 and

E is a connecting group selecting from the group consisting of:

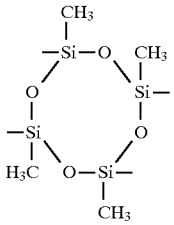

-continued

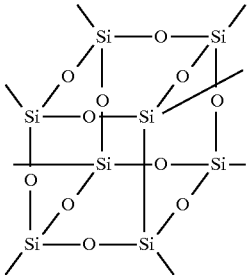

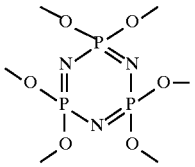

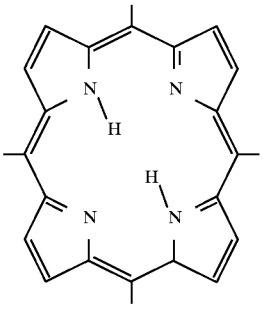

-continued

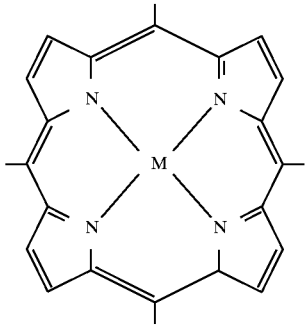

wherein M is a divalent metal ion.

forming a uniform charge on the imaging member, exposing the imaging member to activating radiation in image configuration to form an electrostatic latent image, developing the latent image to form a toner image on the imaging member in conformance to the latent image, and transferring the toner image to a receiving member.

20. An electrophotographic imaging process according to claim 17 wherein said at least one photoconductive layer comprises a charge generating layer and a charge transport layer and the charge transport layer comprises the organic polyarylamine charge transporting material.

* * * * *